US008034521B2

(12) United States Patent
Kuramoto et al.

(10) Patent No.: US 8,034,521 B2
(45) Date of Patent: Oct. 11, 2011

(54) TONER FOR DEVELOPING ELECTROSTATIC CHARGE IMAGE, IMAGE FORMING METHOD AND IMAGE FORMING APPARATUS

(75) Inventors: Shinichi Kuramoto, Numazu (JP); Shinji Ohtani, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 489 days.

(21) Appl. No.: 12/343,025

(22) Filed: Dec. 23, 2008

(65) Prior Publication Data

US 2009/0170019 A1 Jul. 2, 2009

(30) Foreign Application Priority Data

Dec. 28, 2007 (JP) ..... 2007-339336

(51) Int. Cl.
*G03G 9/087* (2006.01)

(52) U.S. Cl. ..... 430/108.1; 430/109.1; 430/137.1

(58) Field of Classification Search ..... 430/108.1, 430/109.1, 137.1
See application file for complete search history.

(56) References Cited

U.S. PATENT DOCUMENTS

| | | | |
|---|---|---|---|
| 5,387,488 | A | 2/1995 | Kaneko et al. |
| 6,787,280 | B2 | 9/2004 | Yamashita et al. |
| 6,846,604 | B2 | 1/2005 | Emoto et al. |
| 6,936,390 | B2 | 8/2005 | Nanya et al. |
| 2004/0021017 | A1 | 2/2004 | Sumiyoshi et al. |
| 2004/0115551 | A1 | 6/2004 | Sugiyama et al. |
| 2004/0131961 | A1 | 7/2004 | Watanabe et al. |
| 2007/0059627 | A1* | 3/2007 | Fukui et al. ..... 430/110.3 |
| 2009/0170018 | A1* | 7/2009 | Kuramoto et al. ..... 430/108.22 |

FOREIGN PATENT DOCUMENTS

| | | |
|---|---|---|
| JP | 52-30437 | 3/1977 |
| JP | 57-79961 | 5/1982 |
| JP | 60-112052 | 6/1985 |
| JP | 60-238847 | 11/1985 |
| JP | 62-245268 | 10/1987 |
| JP | 63-85644 | 4/1988 |
| JP | 1-147472 | 6/1989 |
| JP | 1-147476 | 6/1989 |
| JP | 1-161362 | 6/1989 |
| JP | 1-161363 | 6/1989 |
| JP | 1-161364 | 6/1989 |
| JP | 1-161365 | 6/1989 |
| JP | 1-164956 | 6/1989 |
| JP | 1-164957 | 6/1989 |
| JP | 1-164958 | 6/1989 |
| JP | 1-164959 | 6/1989 |
| JP | 1-173056 | 7/1989 |
| JP | 1-173057 | 7/1989 |
| JP | 1-173058 | 7/1989 |
| JP | 1-173059 | 7/1989 |

(Continued)

*Primary Examiner* — Hoa Le
(74) *Attorney, Agent, or Firm* — Oblon, Spivak, McClelland, Maier & Neustadt, L.L.P.

(57) ABSTRACT

To provide a toner for developing an electrostatic charge image, the toner containing at least a colorant obtained by reacting a polymer with a basic dye, wherein the polymer contains 10 mol % or more of a monomer unit having any one of a sulfonic acid group, a sulfonic acid salt group, a sulfuric acid group and a sulfuric acid salt group as a constitutional unit, and the toner is obtained by forming a toner composition liquid containing at least the colorant into oil droplets in an aqueous medium, and solidifying the oil droplets into solid particles.

9 Claims, 5 Drawing Sheets

FOREIGN PATENT DOCUMENTS

| | | |
|---|---|---|
| JP | 1-173060 | 7/1989 |
| JP | 1-173064 | 7/1989 |
| JP | 1-173065 | 7/1989 |
| JP | 1-173066 | 7/1989 |
| JP | 1-173067 | 7/1989 |
| JP | 1-173068 | 7/1989 |
| JP | 2-2575 | 1/1990 |
| JP | 4-40467 | 2/1992 |
| JP | 7-152202 | 6/1995 |
| JP | 8-211655 | 8/1996 |
| JP | 3063269 | 5/2000 |
| JP | 3068654 | 5/2000 |
| JP | 3141783 | 12/2000 |
| JP | 2004-91560 | 3/2004 |
| JP | 2004-267918 | 9/2004 |
| JP | 2004-331946 | 11/2004 |
| JP | 2005-36220 | 2/2005 |
| JP | 2005-518278 | 6/2005 |
| JP | 2005-232443 | 9/2005 |
| JP | 2005-238342 | 9/2005 |
| JP | 2006-152103 | 6/2006 |
| JP | 2006-193681 | 7/2006 |
| JP | 2007-94351 | 4/2007 |
| JP | 2007-94352 | 4/2007 |
| JP | 2007-101708 | 4/2007 |
| JP | 2007-155926 | 6/2007 |

* cited by examiner

TONER FOR DEVELOPING ELECTROSTATIC CHARGE IMAGE, IMAGE FORMING METHOD AND IMAGE FORMING APPARATUS

BACKGROUND OF THE INVENTION

1. Field of the Invention

The present invention relates to a toner used in a developer in developing an electrostatic charge image formed by an electrophotographic method, an electrostatic recording method, an electrostatic printing method, etc., an image forming method, and an image forming apparatus.

2. Description of the Related Art

An electrophotographic method generally includes the steps of forming a latent electrostatic image on a photoconductor that utilizes a photoconductive material (hereinafter otherwise referred to as "latent electrostatic image bearing member", "image bearing member" or "electrophotographic photoconductor") with the use of various units; developing the latent electrostatic image with toner so as to form a toner image; transferring the toner image onto a recording medium such as paper; fixing the toner image, which has been transferred onto the recording medium, on the recording medium by heating, pressure, thermal pressure, solvent vapor, etc.; and cleaning the photoconductor by removing toner that remains thereon.

A developer used in electrophotography, electrostatic recording, electrostatic printing, etc. is firstly supplied for development on an image bearing member, such as a latent electrostatic image bearing member on which an electrostatic charge image is formed, in a developing step, then the developer is transferred from the image bearing member onto a transfer medium such as transfer paper in a transfer step and subsequently fixed on the transfer medium in a fixing step. As developers used for developing electrostatic charge images formed on latent image bearing surfaces, two-component developers, each of which is composed of a carrier and a toner, and one-component developers (magnetic toners and nonmagnetic toners), which do not require carriers, are known.

Conventionally, so-called pulverized toners, which are each produced by melting and kneading a binder resin such as a styrene resin or polyester resin together with internal additives such as a colorant and then finely pulverizing the melted and kneaded matter, have been widely employed as dry toners used in electrophotography, electrostatic recording, electrostatic printing, etc.

In a toner producing method based upon a pulverization method, in order to secure uniformity in the shape of particles of a toner obtained, it is important to uniformly disperse constituent materials of the toner and then pulverize them. Basically, since the shape of particles of a pulverized toner is indefinite, and cross-sectional shapes formed upon pulverization vary from particle to particle, it is difficult to control the shape and structure of the particles of the pulverized toner. Also, if internal additives such as a colorant, a releasing agent and a charge controlling agent are added in large amounts, pulverization at the interface between a binder resin and the internal additives in a pulverizing process easily causes the internal additives to be exposed on the surface, and variation in chargeability or the like arises among individual toner particles, thereby causing a problem in which toner properties such as fluidity and chargeability degrade.

In recent years, the demand for improvement in image quality has necessitated making toners smaller in particle diameter; however, as the toners are made smaller in particle diameter, the following problems arise. (1) The pulverization energy exponentially increases. (2) Degradation of fluidity, which is also caused by indefinite shapes of toner particles, becomes noticeable and the toner supplying ability, the transferability and the cleaning ability degrade.

(3) Variation in chargeability among individual toner particles, which is caused by pulverization at the interface between a binder resin and internal additives, becomes noticeable.

These days, toner producing methods based upon chemical methods (for example, suspension polymerization method, emulsion polymerization aggregation method, dissolution suspension method, polyester elongation method, phase inversion emulsification method, etc.) for producing toner in solvent are being examined.

The suspension polymerization method is a method for producing a toner by dispersing into a monomer a polymerization initiator and internal additives such as a colorant, a releasing agent and a charge controlling agent, suspending this dispersion solution in a dispersant-containing aqueous medium to form oil droplets, and then raising the temperature so as to subject the monomer in the droplets to a polymerization reaction (refer to Journal of the Imaging Society of Japan Vol. 43, No. 1, pp. 33-39 (2004)).

The following explains an example of the emulsion polymerization aggregation method. First, a colorant is dispersed in a surfactant aqueous solution. Meanwhile, a polymerization initiator, a styrene monomer and an acrylic monomer are added to the surfactant aqueous solution so as to produce a resin emulsion by emulsion polymerization. The colorant dispersion solution, the resin emulsion, and a dispersion solution containing suitably selected other internal additives such as a releasing agent and a charge controlling agent are mixed together, and associated and grown with the addition of a pH adjuster and an aggregating agent so as to have a desired particle diameter, then the mixture is heated and agitated to fuse fine particles, thereby producing a toner (refer to Japanese Patent (JP-B) No. 3141783 and Journal of the Imaging Society of Japan Vol. 43, No. 1, pp. 40-47 (2004)).

The dissolution suspension method is a method that involves volume contraction, including a step of preparing a suspension in which an oily component formed by dissolving a binder resin in an organic solvent capable of dissolving the binder resin is suspended in an aqueous component, and a step of removing the organic solvent from the suspension. Internal additives such as a colorant, a releasing agent and a charge controlling agent are dispersed and dissolved, together with the binder resin, in a volatile solvent such as a low-boiling organic solvent, and this dispersion solution is suspended in a dispersant-containing aqueous medium to form oil droplets, then the volatile solvent is removed. As opposed to the suspension polymerization method and the emulsion polymerization aggregation method, this method is superior in that resins able to be used therein are versatile, notably in that polyester resins useful in a full-color process for which transparency and smoothness of an image portion after its fixation are required can be used (refer to Japanese Patent Application Laid-Open (JP-A) No. 07-152202 and Journal of the Imaging Society of Japan Vol. 43, No. 1, pp. 48-53 (2004)).

The polyester elongation method includes a step of preparing a dispersion solution by emulsifying and aggregating in an aqueous component an oily component formed by dissolving a polyester resin that contains a reactive resin and serves as a binder resin in an organic solvent capable of dissolving the polyester resin, and a step of performing a polyester elongation reaction while removing the organic solvent from the dispersion solution. As opposed to the suspension polymerization method and the emulsion polymerization aggregation method, this method is also superior in that polyester resins useful in a full-color process for which transparency and smoothness of an image portion after its fixation are required can be used, and makes it possible to control the viscoelasticity of a toner by means of the elongation reaction and thus fix an image in a wide temperature range (refer to Journal of the Imaging Society of Japan Vol. 43, No. 1, pp. 54-59 (2004)).

The phase inversion emulsification method includes dispersing and dissolving a binder resin and internal additives such as a colorant, a releasing agent and a charge controlling agent in a volatile solvent such as a low-boiling organic solvent, injecting a continuous aqueous phase into this dispersion solution so as to change the phase from a W/O dispersion system to an O/W dispersion system and thereby to form oil droplets, and subsequently removing the volatile solvent. This method is also superior in that resins able to be used therein are versatile, notably in that polyester resins useful in a full-color process for which transparency and smoothness of an image portion after its fixation are required can be used (refer to JP-B No. 3063269 and JP-A No. 08-211655).

Toners capable of effectively exhibiting desired functions in view of recent environmental problems, for example capsule toners and core-shell toners, are known to be among toners produced in accordance with such chemical methods.

Compared with pulverization methods, those chemical methods make it possible to produce toners which are small in particle diameter and narrow in particle size distribution.

In order to prevent degradation of fluidity, transferability and cleaning ability owing to reduction in the size of toner particles, which arises in pulverization methods, and to prevent decrease in chargeability and degradation of temporal stability and environmental adaptability owing to the surface hydrophilicity of toner, which arise in the case of chemical toners, conventional toners are generally formed by attaching inorganic or organic fine particles onto surfaces of toner particles such that the adhesion of the toners is reduced by the effects of these fine particles. Additionally, also in order to provide sufficient fluidity in conveying toner from a toner container to a developing unit, inorganic or organic fine particles are generally attached onto surfaces of toner particles.

For those fine particles, hydrophobic fine powders typified by hydrophobic silica, etc. (refer to JP-A No. 52-30437), fine silica particles mixed with fine aluminum oxide particles, fine titanium oxide particles, etc. (refer to JP-A No. 60-238847), alumina-coated fine titania particles (refer to JP-A No. 57-79961) and so forth are known to be used. As for titanium oxide, the following have been proposed: titanium oxide having an anatase crystalline structure (refer to JP-A No. 60-112052), aluminum oxide-coated titanium oxide (refer to JP-A No. 57-79961), and fine titanium oxide particles surface-treated with a coupling agent (refer to JP-A No. 04-40467). In general, however, silica, which yields the greatest fluidity-providing effect, is used. By using these hydrophobic fine powders such as silica, the fluidity, the developing ability and the transferability can be improved to a fairly great extent.

However, when used in a copier, a printer, etc., these external additives held on surfaces of toner particles are always subject to mechanical stress in a developing device, a transfer unit, a cleaning unit, etc.; thus, as the external additives are embedded in the toner particles or detach from the surfaces thereof, the adhesiveness of toner increases with time, which leads to a decrease in transfer efficiency and cleaning reliability.

In recent years, it has been required that images with a quality comparable with that of offset printed images or photographs be realized by using electrophotographic dry toner, and it has been hoped that the size of toner particles can be reduced to obtain a high resolution, that the amount of toner attached can be reduced and the pile height of a toner layer can be lowered to obtain a texture which is as natural as that of offset printed matter, and that the transparency of color material can be further enhanced to widen the color reproducible range.

Generally, the amount of pigment contained in a toner is increased in order to reduce the amount of toner attached, lower the pile height of a toner layer and maintain an image density; however, when the amount of pigment is increased, image fixation may be hindered, and the presence of the pigment on the surface may possibly make charging unstable and thus cause image degradation. As to chemical toners produced by chemical methods such as suspension polymerization method and dissolution suspension method, an increase in the viscosity of solution makes it difficult to form droplets and obtain particles in some cases.

As means for further enhancing the transparency of color material so as to widen the color reproducible range, fine dispersion of pigment and use of dye are known.

As to techniques of finely dispersing pigment, especially in order to stabilize the dispersion of the pigment in organic solvent, a graft polymer pigment dispersant has been proposed as described in JP-A No. 2005-232443, and a pigment dispersant using a silicone macromer has been proposed as described in JP-A No. 2005-36220. JP-A Nos. 2007-94352, 2007-94351 and 2007-155926 each describe an appropriate means of dispersing pigment in a method for obtaining toner particles by forming a toner composition liquid into oil droplets in an aqueous medium and solidifying the oil droplets into solid particles. When pigment is finely dispersed to a greater extent, a larger amount of a pigment dispersant is required to stabilize the dispersion, and thus there are such problems that the charge stabilization of toner is hindered and the fixation properties of the toner are greatly changed. As techniques for finely pulverizing pigment, use of a ball mill and use of a bead mill are generally known. In recent years, for finer pulverization, pulverization methods utilizing laser abrasion have been proposed as described in JP-A Nos. 2004-267918 and 2005-238342, methods for finely dispersing pigment by means of dissolution and deposition have been proposed as described in JP-A Nos. 2004-331946, 2004-091560 and 2006-193681, and methods for producing pigment in the form of fine particles by spraying and drying pigment solution have been proposed as described in JP-A Nos. 2005-518278 and 2006-152103; however, in each method, use of a large amount of a pigment dispersant is required to stabilize the dispersion, and thus there still remain such problems that the charge stabilization of toner is hindered and the fixation properties of the toner are greatly changed.

Although superior in color tone and transparency, dyes present such problems that they have poor light resistance, they move when stored, causing image bleeding, and they stain a film or the like when kept in contact with the film or the like. Solutions to these problems include use of a polymeric dye. JP-A No. 62-245268 describes a polymeric dye in which a bisphenol dye is introduced into a polyester skeleton, JP-A No. 63-85644 describes a polymeric dye produced by polymerizing a vinyl group-containing azo dye, and JP-A Nos. 01-147472, 01-147476, 01-161362, 01-161363, 01-161364, 01-161365, 01-164956, 01-164957, 01-164958, 01-164959, 01-173056, 01-173057, 01-173058, 01-173059, 01-173060, 01-173064, 01-173065, 01-173066, 01-173067, 01-173068 and 02-2575 each describe a polymeric dye to which a rhodamine dye is added, etc.; however, since special dyes are used therefor, there is such a problem that the polymeric dyes obtained are rather expensive.

Additionally, JP-B 3068654 describes an electrostatic photographic toner which contains a colorant obtained by reacting together a basic dye and a resin having a carboxyl group or sulfonyl group as a side chain group, and JP-A No. 2007-101708 describes colored particles and a color toner in which the amount of resin functional groups and the amount of dye reacting with resin are determined; however, the foregoing are similar to those obtained by a conventional technique in terms of particle size distribution and toner properties.

Thus, as to a toner which enables a wide color reproducible range and an image having a sharp color tone and high transparency, which has a sharp particle size distribution and favorable toner properties such as chargeability, environmental adaptability and stability over time, which does not produce waste liquid, contains no residual monomer and does not require a drying process and which is low in cost, and an image forming method using the toner, those capable of exhibiting sufficiently satisfactory performance have not yet been provided in reality.

BRIEF SUMMARY OF THE INVENTION

Designed in light of the present situation described above, the present invention is aimed at solving the problems in related art and achieving the following object. An object of the present invention is to provide a toner for developing an electrostatic charge image, superior in transferability and cleaning ability and capable of forming a sharp high-quality image; and an image forming method and an image forming apparatus each using the toner.

Another object of the present invention is to provide a toner for developing an electrostatic charge image, used in a developer for developing an electrostatic charge image in electrophotography, electrostatic recording, electrostatic printing, etc., characterized in that an environmental load at the time of production of the toner can be reduced, the toner can be efficiently produced, and since the toner is composed of particles having uniform dispersibility achieved with an unprecedented particle size, variations caused depending upon particles, observed in conventional toner producing methods, do not exist or are very small with respect to the values of most of the properties required for the toner such as fluidity and chargeability; and an image forming method and an image forming apparatus each using the toner.

As a result of carrying out a series of earnest examinations to solve the above-mentioned problems, the present inventors have found that in a method for obtaining toner particles by forming a toner composition liquid into oil droplets in an aqueous medium and solidifying the oil droplets into solid particles, use of a colorant soluble in organic solvent, obtained by reacting a polymer with a basic dye, makes it possible to greatly reduce the amount of particles dispersed in the toner composition liquid, and thus to stabilize a granulating process greatly and obtain toner particles having highly uniform dispersibility, in which interparticle variations in the values of most of the properties required for the toner such as fluidity and chargeability are very small.

Further, it has been found that a toner which is capable of forming a sharp high-quality image and does not discolor much can be obtained.

The present invention is based upon the knowledge of the present inventors, and means for solving the problems are as follows.

<1> A toner for developing an electrostatic charge image, the toner containing at least:

a colorant obtained by reacting a polymer with a basic dye, wherein the polymer contains 10 mol % or more of a monomer unit having any one of a sulfonic acid group, a sulfonic acid salt group, a sulfuric acid group and a sulfuric acid salt group as a constitutional unit, and wherein the toner is obtained by forming a toner composition liquid containing at least the colorant into oil droplets in an aqueous medium, and solidifying the oil droplets into solid particles.

<2> The toner according to <1>, wherein the toner composition liquid is prepared by dissolving at least the colorant in an organic solvent.

<3> The toner according to one of <1> and <2>, wherein the polymer contains 10 mol % or more of at least one monomer unit selected from the group consisting of 2-(meth)acrylamido-2-methylpropanesulfonic acid, salts of 2-(meth)acrylamido-2-methylpropanesulfonic acid, styrenesulfonic acid and salts of styrenesulfonic acid as a constitutional unit.

<4> The toner according to any one of <1> to <3>, wherein the polymer contains 10 mol % or more of at least one monomer unit selected from the group consisting of 2-(meth)acrylamido-2-methylpropanesulfonic acid, salts of 2-(meth)acrylamido-2-methylpropanesulfonic acid, styrenesulfonic acid and salts of styrenesulfonic acid as a constitutional unit, and also contains a monomer unit of an acrylate or methacrylate alkyl ester as a constitutional unit.

<5> The toner according to any one of <1> to <4>, wherein the process of forming the toner composition liquid into oil droplets in the aqueous medium and solidifying the oil droplets into solid particles is based upon a suspension polymerization method.

<6> The toner according to any one of <1> to <4>, wherein the process of forming the toner composition liquid into oil droplets in the aqueous medium and solidifying the oil droplets into solid particles is based upon a dissolution suspension method.

<7> The toner according to any one of <1> to <4>, wherein the process of forming the toner composition liquid into oil droplets in the aqueous medium and solidifying the oil droplets into solid particles is a process in which a toner composition liquid prepared by dissolving or dispersing in an organic solvent the colorant and a polymer that serves as a binder resin having a site reactable with a compound having at least an active hydrogen group is dispersed and formed into oil droplets in an aqueous medium, the oil droplets are solidified into solid particles by removing the organic solvent after or while subjecting the binder resin having a site reactable with a compound having an active hydrogen group to a reaction with the compound having an active hydrogen group, then the solid particles are washed and dried.

<8> A developer including the toner according to any one of <1> to <7>.

<9> A toner container including a container body adapted to house the toner according to any one of <1> to <7>.

<10> A process cartridge detachably mountable to an image forming apparatus main body, the process cartridge including at least:

a latent electrostatic image bearing member, and a developing unit configured to develop a latent electrostatic image formed on the latent electrostatic image bearing member, using the toner according to any one of <1> to <7>, so as to form a visible image on the latent electrostatic image bearing member.

<11> An image forming method including at least forming a latent electrostatic image on a latent electrostatic image bearing member; developing the latent electrostatic image, using the toner according to any one of <1> to <7>, so as to form a visible image; transferring the visible image onto a recording medium; and fixing the transferred visible image on the recording medium by heating and pressurizing the visible image with the use of a fixing member in the form of one of a roller and a belt.

<12> An image forming apparatus including at least a latent electrostatic image bearing member; a latent electrostatic image forming unit configured to form a latent electrostatic image on the latent electrostatic image bearing member; a developing unit configured to develop the latent electrostatic image, using the toner according to any one of <1> to <7>, so as to form a visible image; a transfer unit configured to transfer the visible image onto a recording medium; and a fixing unit configured to fix the transferred visible image on the recording medium by heating and pressurizing the visible image with the use of a fixing member in the form of one of a roller and a belt.

According to the present invention, it is possible to provide a toner for developing an electrostatic charge image, characterized in that the use of a colorant soluble in organic solvent, obtained by reacting a specific polymer with a basic dye, makes it possible to stabilize a granulating process greatly and solve the problems in related art, and the toner is superior in transferability and cleaning ability and capable of not only forming a sharp high-quality image but also stably forming a high-quality, high-definition color image regardless of the environment and the length of time for which the toner has been used; and an image forming method and an image forming apparatus each using the toner.

Also, according to the present invention, it is possible to provide a toner for developing an electrostatic charge image, used in a developer for developing an electrostatic charge image in electrophotography, electrostatic recording, electrostatic printing, etc., characterized in that the problems in related art can be solved, an environmental load at the time of production of the toner can be reduced, the toner can be efficiently produced, and since the toner is composed of particles having uniform dispersibility achieved with an unprecedented particle size, variations caused depending upon particles, observed in conventional toner producing methods, do not exist or are very small with respect to the values of most of the properties required for the toner such as superior chargeability; and an image forming method and an image forming apparatus each using the toner.

Specifically, the toner has such a significant feature that variations in property values caused by variation of particles, observed in relation to conventional toners produced by pulverization methods or chemical methods, do not exist or are vanishingly small. This feature will only be able to be realized by the present invention, and the realization of this feature has made it possible for the first time to form an image which is extremely faithful to a latent image formed on a photoconductor. Also, such a feature of the toner has made it possible to sustain the effects for a long period of time. Specifically, it is inferred that this is because the achievement of uniformity of particle size distribution, uniformity of particle shape and uniformity of particle surface conditions has enabled a great reduction in the mechanical stress required to attain the charged amount of the toner predetermined in an electrophotographic process, and thus dramatically lengthened the lifetime of the toner. Thus, images which are excellent in quality can be obtained for a long period of time.

DETAILED DESCRIPTION OF THE INVENTION

Figure 1:
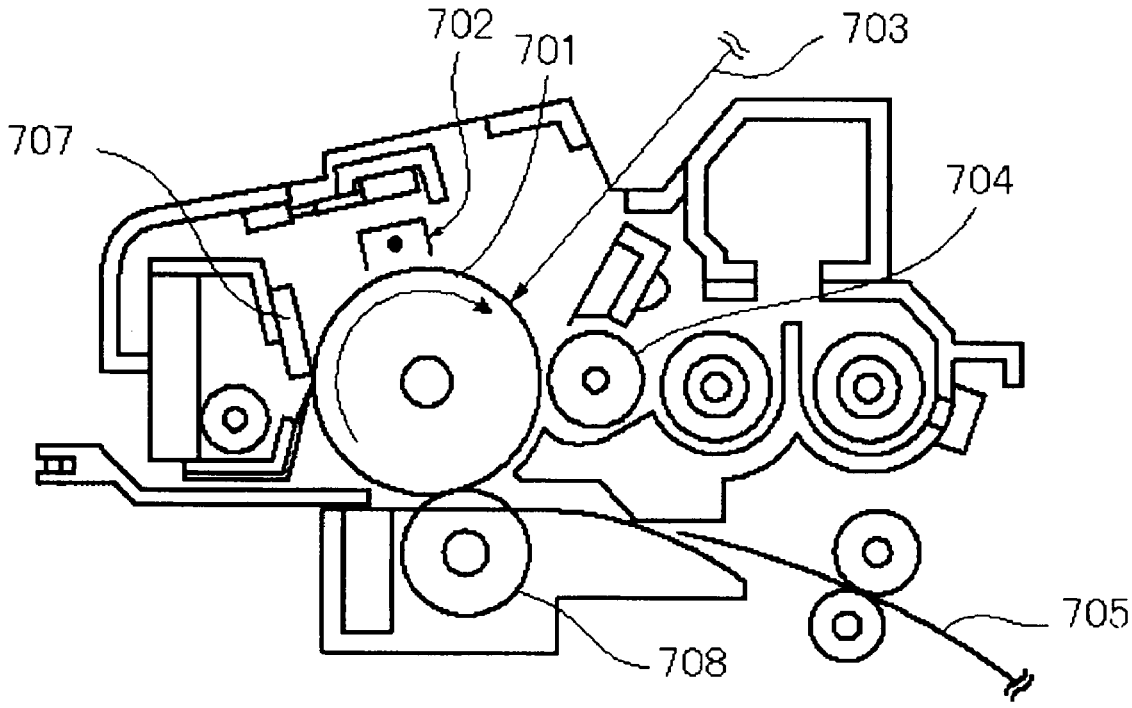
FIG. 1 is a schematic explanatory diagram showing an example of a process cartridge used in the present invention.

A toner of the present invention for developing an electrostatic charge image is a toner for developing an electrostatic charge image, including at least a binder resin and a colorant, characterized in that use of a colorant obtained by reacting a specific polymer with a basic dye makes it possible to greatly reduce the amount of particles dispersed in a toner composition liquid, and thus to stabilize a granulating process further and obtain toner particles having highly uniform dispersibility, in which interparticle variations in the values of most of the properties required for the toner such as fluidity and chargeability are very small; furthermore, the toner is capable of forming a sharp high-quality image and does not discolor much.

The following describes a colorant obtained by reacting a basic dye with a polymer which contains a monomer having any one of a sulfonic acid group, a sulfonic acid salt group, a sulfuric acid group and a sulfuric acid salt group, in explaining a method for producing a toner for developing an electrostatic charge image, and the following also reveals details of the toner of the present invention for developing an electrostatic charge image.

The colorant used in the present invention, obtained by reacting a basic dye with a polymer which contains a monomer unit having any one of a sulfonic acid group, a sulfonic acid salt group, a sulfuric acid group and a sulfuric acid salt group as a constitutional unit, is a colorant obtained by reacting a basic dye with a polymer in which a monomer unit having any one of a sulfonic acid group, a sulfonic acid salt group, a sulfuric acid group and a sulfuric acid salt group occupies 10 mol % or more as a constitutional unit. The colorant obtained by reacting the basic dye with the polymer which contains a monomer unit having any one of a sulfonic acid group, a sulfonic acid salt group, a sulfuric acid group and a sulfuric acid salt group as a constitutional unit is preferably either dissolved or finely dispersed in an organic solvent to constitute a toner composition liquid, which is composed of toner materials in liquid form, with the addition of other components such as a binder resin, wax and a magnetic material if necessary.

In the case where the polymer used in the present invention is a vinyl polymer, examples of vinyl monomers having a sulfonic acid group and/or a sulfonic acid salt group, and/or a sulfuric acid group and/or a sulfuric acid salt group, which is contained as a monomer unit in the vinyl polymers, include 2-(meth)acryloyloxyethanesulfonic acid, 2-(meth)acryloyloxypropane sulfonic acid, 2-(meth)acrylamido-2-alkyl (having 1 to 4 carbon atoms) propanesulfonic acid, vinylsulfonic acid, allylsulfonic acid, styrenesulfonic acid, α-methylstyrenesulfonic acid, vinyltoluenesulfonic acid, vinylnaphthalenesulfonic acid and vinylsulfuric acid. Among these, 2-(meth)acryloyloxyethanesulfonic acid, 2-(meth)acryloyloxypropane sulfonic acid, 2-(meth)acrylamido-2-alkyl (having 1 to 4 carbon atoms) propanesulfonic acid and styrenesulfonic acid are preferable in that they are highly polymerizable and therefore high-molecular-mass materials can be easily obtained; particular preference is given to 2-acrylamido-2-methylpropanesulfonic acid and styrenesulfonic acid, more particularly 2-acrylamido-2-methylpropanesulfonic acid.

Each of these constituent monomers may be used as an acid or may be used as a salt, with part or all of its sulfonic acid groups and/or sulfuric acid groups neutralized by a base.

Examples of counterions used in forming salt groups of sulfonic acid groups or sulfuric acid groups include metal ions, ammonium ions, alkyl or alkenyl ammonium ions each having 1 to 22 carbon atoms in total, alkyl- or alkenyl-substituted pyridinium ions each having 1 to 22 carbon atoms in total, and alkanolammonium ions each having 1 to 22 carbon atoms in total; particular preference is given to ammonium ions and ions of alkali metals such as sodium ions and potassium ions, more particularly sodium ions and potassium ions.

The polymer may be formed as a copolymer including a styrene-based monomer such as styrene, α-methylstyrene or divinylbenzene; an acrylate or methacrylate alkyl ester monomer such as methyl acrylate, methyl methacrylate, ethyl acrylate, ethyl methacrylate, n-butyl methacrylate, i-butyl methacrylate, t-butyl methacrylate, hexyl acrylate, cyclohexyl acrylate, octyl acrylate or 2-ethylhexyl acrylate; an unsaturated carboxylic acid monomer such as acrylic acid, methacrylic acid, maleic anhydride, maleic acid, fumaric acid or itaconic acid; a nitrogen-containing acrylate or methacrylate monomer such as dimethylamino acrylate, dimethylaminoethyl acrylate, diethylaminoethyl acrylate, diethylaminopropyl acrylate, N-aminoethyl aminopropyl acrylate, dimethylamino methacrylate, dimethylaminoethyl methacrylate, diethylaminoethyl methacrylate, diethylaminopropyl methacrylate or N-aminoethyl aminopropyl methacrylate; or a monomer such as 2-hydroxyethyl acrylate, 3-hydroxypropyl acrylate, 4-hydroxybutyl acrylate or 2-hydroxyethyl methacrylate.

To enhance the polymer's compatibility with the binder resin and the polymer's solubility in the organic solvent, an acrylate or methacrylate alkyl ester monomer is preferably used.

As to any of these monomers, an ordinary radical polymerization monomer in water is introduced into a polymerization container along with an ordinary radical polymerization initiator in water, for example a persulfate such as potassium persulfate or ammonium persulfate, an organic peroxide such as cumene hydroperoxide or t-butyl hydroperoxide, or a compound such as azobisisobutyronitrile or azobisisovaleronitrile, and thusly subjected to polymerization. The copolymerizable monomer can be subjected to polymerization in organic solvent, depending upon its type or amount.

When the amount of the monomer having any one of a sulfonic acid group, a sulfonic acid salt group, a sulfuric acid group and a sulfuric acid salt group is small, the coloring strength is low, so that it is appropriate that the amount of the monomer having an acid group be 10 mol % or greater, preferably 30 mol % or greater.

Specific examples of the basic dyes for use include C. I. Basic Yellow 1, 2, 11, 13, 14, 19, 21, 25, 36, 28, 40 and 73, Basic Orange 21, 22 and 30, Basic Red 12, 13, 14, 18, 27, 36, 38, 39, 46, 69 and 70, Basic Violet 7, 10, 11, 15, 16, 27 and 28, Basic Blue 1, 4, 7, 9, 26, 35, 41, 45, 65, 66, 67, 75, 77 and 129, and Basic Green 4.

As to the basic dye and the polymer, when the pH is set at 2 to 7, preferably 3 to 5, dyeing proceeds. The temperature is 30° C. to 100° C., preferably 50° C. to 80° C. When the temperature is low, the reaction takes a great deal of time. When the temperature is high, there may possibly be a problem, for example a change in material quality. The reaction takes place in 20 min to 2 hr, when the temperature is 40° C. to 60° C. Not necessarily limited to water, the solvent may be an organic solvent such as N-vinylpyrrolidone or acrylonitrile, or a mixed solvent of the organic solvent and water.

When the dyeing sufficiently proceeds, the polymer increases in organicity and becomes insoluble in water and organic solvents such as N-vinylpyrrolidone and acrylonitrile; accordingly, a colorant produced by means of the reaction between the polymer and the basic dye can be obtained by repeating filtering and washing several times and drying the obtained cake. A toner composition liquid used in the present invention can be obtained by dissolving or finely dispersing the obtained colorant in an organic solvent.

Here, it is desirable that the glass transition temperature of the colorant produced by means of the reaction between the polymer and the basic dye be 30° C. to 80° C. because even when the amount of the colorant is increased, the thermal properties of the toner are not greatly affected.

Examples of the organic solvent include monohydric alcohols, dihydric alcohols, aromatic hydrocarbons, aliphatic hydrocarbons, esters, ketones, alicyclic hydrocarbons and volatile organopolysiloxanes. Specific examples thereof include methanol, ethanol, 2-propanol, n-butanol, propylene glycol, toluene, xylene, isopentane, n-hexane, n-heptane, ethyl acetate, butyl acetate, acetone, methyl ethyl ketone and cyclohexane.

The present invention pertains to a method for producing toner particles by forming a toner composition liquid into oil droplets in an aqueous medium and solidifying the oil droplets into solid particles, and known methods for doing so include suspension polymerization method, dissolution suspension method and polyester elongation method.

The suspension polymerization method is a method for producing a toner by dispersing into a monomer a polymerization initiator and internal additives such as a colorant, a releasing agent and a charge controlling agent so as to prepare a toner composition liquid, suspending this toner composition liquid in a dispersant-containing aqueous medium to form oil droplets, and then raising the temperature so as to subject the monomer in the droplets to a polymerization reaction. As the colorant, a colorant obtained by reacting the polymer with a basic dye is used, and examples of polymerizable monomers constituting a polymerizable monomer system, and of toner property providing agents such as colorants are as follows.

Examples of polymerizable monomers include styrene monomers such as styrene, o-methylstyrene, m-methylstyrene, p-methylstyrene, p-methoxystyrene and p-ethylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chlorethyl acrylate and phenyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and monomers such as acrylonitrile, methacrylonitrile and acrylamide.

In the present invention, a cross-linking agent may be added, with its amount being preferably 0.001% by mass to 15% by mass.

Each of these monomers can be used alone or in combination. Among these monomers, it is desirable in terms of the developing properties and durability of the toner that styrene or a styrene derivative be used alone or in combination with other monomer. In the present invention, polymerization may take place with a resin added to the monomer system.

As to the polymerization initiator used in the present invention, when a polymerization initiator whose half-life is 0.5 hr to 30 hr at the time of polymerization reaction is added to bring about a polymerization reaction, with its amount being equivalent to 0.5% by mass to 20% by mass of the polymerizable monomer, a polymer having its peak in the molecular mass range of 10,000 to 100,000 can be obtained, thereby enabling the toner to have desirable strength and appropriate melting properties. Examples of the polymerization initiators include azo and diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide and lauroyl peroxide.

Examples of inorganic compounds used as dispersants (dispersion stabilizers) include calcium phosphate, hydroxyapatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. Examples of organic compounds used as dispersants (dispersion stabilizers) include polyvinyl alcohol, gelatin, methylcellulose, methylhydroxypropylcellulose, ethylcellulose, sodium salts of carboxymethylcellulose, polyacrylic acid and salts thereof, and starch. Any of these may be used, being dispersed in an aqueous phase.

It is inferred that any of these dispersion stabilizers prevents aggregation among polymerizable monomer composition particles that are evenly dispersed as droplets in an aqueous medium, and uniformly adsorbs onto the surfaces of these droplets, thereby stabilizing the droplets. Any of these dispersion stabilizers is made soluble through acid or alkali treatment, washing with hot water, etc. and separated from toner particles, after the polymerizable monomer in the droplets has finished undergoing a polymerization reaction. However, it is often difficult for some of the above-mentioned substances usable as dispersants to be completely removed from the toner particle surface for reasons related to their solubility, molecular mass, viscosity, etc.; moreover, in processes such as strong alkali treatment and washing with hot water, since part of a colorant and a charge controlling agent degenerates, decomposes, dissolves and/or thermally deforms depending upon the particle composition of the toner, the surface properties, frictional chargeability, color reproducibility and the like of toner particles are impaired and thus the developing properties and the like of the toner greatly degrade in some cases. Meanwhile, some inorganic dispersants, because of their strong aggregating action, undesirably promote instability, for example aggregation or coalescence of droplets, when the stability of the droplets decreases due to a viscosity change, etc. in the midst of the polymerization reaction of the droplets.

Calcium phosphate salts can be suitably used as dispersion stabilizers, and specific examples thereof include calcium phosphate, calcium hydrogenphosphate, calcium dihydrogenphosphate, hydroxyapatite, and mixtures thereof. It is desirable that 0.2 parts by mass to 20 parts by mass of any of these dispersants be used per 100 parts by mass of the polymerizable monomer.

For fine dispersion of any of these dispersants, 0.001 parts by mass to 0.1 parts by mass of a surfactant may be added per 100 parts by mass of the polymerizable monomer. Specific examples of the surfactant include sodium dodecylbenzenesulfonate, sodium tetradecylsulfonate, sodium pentadecylsulfonate, sodium octylsulfonate, sodium oleate, sodium laurate, potassium stearate and calcium oleate.

Hydroxyapatite or calcium phosphate may be used in powder form; however, hydroxyapatite or calcium phosphate is preferably produced in water, using such substances as sodium phosphate and calcium chloride, and used. When this technique is used, a very fine salt can be obtained, which enables a stable suspended state, and thus favorable granulating ability can be yielded.

Specifically, in preparing a calcium phosphate salt by mixing a phosphate aqueous solution and a calcium salt aqueous solution, the pH of an aqueous medium containing the calcium phosphate salt is adjusted in such a manner as to be greater than 6.0 and less than or equal to 8.5, using a dilute solution of a water-soluble inorganic acid such as hydrochloric acid, sulfuric acid or nitric acid. In this pH adjustment, a diluted acid may be added after the calcium phosphate salt has been prepared by mixing the two solutions; alternatively, the diluted acid may be previously added into the phosphate aqueous solution or the calcium salt aqueous solution before the mixing of these two solutions, then the calcium salt aqueous solution or the phosphate aqueous solution may be mixed therewith to precipitate the calcium phosphate salt. As to the preparation of the calcium phosphate salt, preparation thereof in a dispersion granulator such as a homomixer or homogenizer is advantageous; nevertheless, a previously prepared aqueous dispersion solution containing a calcium phosphate salt may be poured into the dispersion granulator.

The monomer composition is poured into the aqueous medium containing the calcium phosphate salt, whose pH has been adjusted in this manner, and dispersed to form particles. Thereafter, the state of particles of the monomer system is kept stable due to the pH and the action of the calcium phosphate salt as a dispersion stabilizer; also, by stirring the solution to such an extent that precipitation of the particles of the monomer system is prevented, the monomer composition can be stably polymerized without the occurrence of aggregation or coalescence of the particles, as the polymerization reaction proceeds. The polymerization is carried out with the polymerization temperature set at 40° C. or higher, generally 50° C. to 90° C.

The temperature may be raised in the latter half of the polymerization reaction, and the aqueous medium may be partially distilled away in the latter half or at the end of the polymerization reaction to remove an unreacted polymerizable monomer, a by-product and the like, which cause an unpleasant smell at the time of toner fixation, etc. After the polymerization reaction has finished, in order to remove the calcium phosphate salt, toner particles produced are subjected to a treatment for a predetermined length of time, in which the pH is kept in the range of 1.0 to 3.0 by further addition of the water-soluble inorganic acid such as hydrochloric acid, sulfuric acid or nitric acid; subsequently, the ingredients are sufficiently washed with water, then the toner particles are filtered out and thusly recovered.

The dissolution suspension method is a method that involves volume contraction, including a step of preparing a suspension in which an oily component formed by dissolving a binder resin in an organic solvent capable of dissolving the binder resin is suspended in an aqueous component, and a step of removing the organic solvent from the suspension.

Internal additives such as a colorant, a releasing agent and a charge controlling agent are dispersed and dissolved, together with the binder resin, in a volatile organic solvent such as a low-boiling organic solvent to constitute a toner composition liquid, and this toner composition liquid is suspended in a dispersant-containing aqueous medium to form oil droplets, then the volatile organic solvent is removed. This method is superior in that resins able to be used therein are versatile, notably in that polyester resins useful in a full-color process for which transparency and smoothness of an image portion after its fixation are required can be used.

As for polyesters applicable to the present invention, in specific terms, polyesters obtained by means of condensation polymerization between alcohol components and carboxylic acid components can be used. Examples of the alcohol components include dihydric or higher alcohols and alcohol derivatives, such as ethylene glycol, diethylene glycol, triethylene glycol, polyethylene glycol, propylene glycol, butanediol, pentanediol, hexanediol, cyclohexane dimethanol, xylylene glycol, dipropylene glycol, polypropylene glycol, bisphenol A, hydrogenated bisphenol A, bisphenol A ethylene oxide, bisphenol A propylene oxide, sorbitol and glycerin. Examples of the carboxylic acid components include divalent or higher carboxylic acids, carboxylic acid derivatives and carboxylic acid anhydrides, such as maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride and dodecenyl succinic anhydride. Two or more of these alcohol components and two or more of these carboxylic acid components may be combined together.

Among these, as alcohol components, polyhydric aromatic alcohols are preferable, particularly bisphenol A ethylene oxide adducts and bisphenol A propylene oxide adducts. As carboxylic acid components, polyvalent aromatic carboxylic acids are preferable, particularly terephthalic acid.

Examples of monocarboxylic acid components include acetic acid, acetic anhydride, benzoic acid, trichloroacetic acid, trifluoroacetic acid and propionic anhydride, with preference being given to aliphatic monocarboxylic acids, particularly acetic anhydride.

Examples of usable monoalcohol components include monoalcohols such as methanol, ethanol, propanol, octanol, 2-ethylhexanol, trifluoroethanol, trichloroethanol, hexafluoroisopropanol and phenol, with preference being given to octanol and 2-ethylhexanol.

Among polyester resins applicable to the present invention, those having a mass average molecular mass in the range of 5,000 to 80,000 are preferable. When a polyester resin having a mass average molecular mass of less than 5,000 is used, fixation failure easily arises at high temperatures. When a polyester resin having a mass average molecular mass of greater than 80,000 is used, the fixation strength easily decreases.

For the binder resin in the present invention, a polyester resin may be used alone or in combination with other resin. Examples of the other resins include polystyrene and polyamides.

Examples of the organic solvents include monohydric alcohols, dihydric alcohols, aromatic hydrocarbons, aliphatic hydrocarbons, esters, ketones, alicyclic hydrocarbons and volatile organopolysiloxanes. Specific examples thereof include methanol, ethanol, 2-propanol, n-butanol, propylene glycol, toluene, xylene, isopentane, n-hexane, n-heptane, ethyl acetate, butyl acetate, acetone, methyl ethyl ketone and cyclohexane.

The toner composition liquid which has been dissolved or dispersed in the solvent is utilized to form particles having a predetermined diameter, in an aqueous medium which contains an inorganic dispersant.

For the aqueous medium in the present invention, water is mainly used, and a mixture of water and a water-soluble solvent may also be used. As the water-soluble solvent, an alcohol such as methanol or ethanol, acetone, or the like can be used.

Addition of the dispersant is preferable in view of the particle size distribution of the toner. The dispersant can be selected from inorganic dispersants such as tricalcium phosphate, hydroxyapatite, calcium carbonate, titanium oxide, aluminum hydroxide, magnesium hydroxide, barium sulfate and silica. The amount of the inorganic dispersant is preferably 0.1 parts by mass to 30 parts by mass per 100 parts by mass of the aqueous medium. The average particle diameter of the inorganic dispersant is preferably 1 μm or less.

It is desirable to add a water-soluble polymer as a dispersion stabilizer to the aqueous medium. Specific examples of the water-soluble polymer include cellulose, hydroxypropylmethylcellulose, methylcellulose, carboxymethylcellulose, starch, polyvinyl alcohol, polyacrylic acid, alkali metal salts (e.g. sodium salt and potassium salt) of these compounds, and alkaline earth metal salts (e.g. calcium salt and magnesium salt) of these compounds.

Particles of a toner base liquid are formed in the aqueous medium which contains the inorganic dispersant, preferably with high-speed shearing. The average particle diameter of the toner base liquid dispersed in the aqueous medium is preferably 10 μm or less, particularly preferably 4 μm to 9 μm. A device equipped with a high-speed shearing mechanism may be selected from various high-speed dispersing devices, with preference being given to homogenizers. Specific examples of the homogenizers include T.K. HOMO MIXER and LINE-FLOW HOMO MIXER (both of which are manufactured by Tokushukika Kogyo Co., Ltd.), SILVERSON HOMOGENIZER (manufactured by Silverson Machines, Inc.), and POLYTRON HOMOGENIZER (manufactured by KINEMATICA AG). As for an agitating condition with the use of a homogenizer, the circumferential velocity of a rotor blade is preferably 2 m/sec or greater. When the circumferential velocity is less than 2 m/sec, particles tend to be insufficiently made fine.

In present invention, after the particles of the toner base liquid have been formed in the aqueous medium which contains the inorganic dispersant, the solvent is removed. The solvent may be removed at normal temperature and normal pressure, but if so, it takes a long time to remove the solvent; accordingly, it is desirable that the solvent be removed under a temperature condition where the temperature is lower than the boiling point of the solvent and the difference between the temperature and the boiling point is 80° C. or less. The pressure may be normal pressure or reduced pressure; when the pressure is reduced, a reduced pressure of 20 mmHg to 150 mmHg is preferably employed.

The toner of the present invention is preferably washed, for example, with hydrochloric acid after the removal of the solvent. This makes it possible to remove an inorganic dispersant remaining on the toner surface and thus to restore the original composition of the toner and improve the properties of the toner. Subsequently, with dehydration and drying, toner particles in powder form can be obtained.

The polyester elongation method includes a step of preparing a dispersion solution by emulsifying and aggregating in an aqueous component an oily component formed by dissolving a polyester resin that contains a reactive resin and serves as a binder resin in an organic solvent capable of dissolving the polyester resin, and a step of performing a polyester elongation reaction while removing the organic solvent from the dispersion solution.

In the present invention, a toner can be obtained in the following manner: a toner composition liquid prepared by dissolving or dispersing in an organic solvent the colorant and a polymer that serves as a binder resin having a site reactable with a compound having at least an active hydrogen group is dispersed and formed into oil droplets in an aqueous medium, the oil droplets are solidified into solid particles by removing the organic solvent after or while subjecting the binder resin having a site reactable with a compound having an active hydrogen group to a reaction with the compound having an active hydrogen group, then the solid particles are washed and dried.

For the polymer that serves as a binder resin having a site reactable with a compound having at least an active hydrogen group, a polyester prepolymer is suitable.

The polyester prepolymers having a group reactable with a compound having an active hydrogen group is a polyester prepolymer having an isocyanate group, epoxy group, carboxylic acid or acid chloride group, preferably a polyester prepolymer having an isocyanate group.

Examples of the polyester prepolymers having an isocyanate group include a compound formed by reacting a polyisocyanate with a polyester which is a polycondensate of a polyol and a polycarboxylic acid and which has an active hydrogen-containing group.

Examples of the active hydrogen-containing groups which the polyester has include hydroxyl groups (alcoholic hydroxyl group and phenolic hydroxyl group) and carboxyl group, with preference being given to alcoholic hydroxyl group.

The number average molecular mass of the polyester having a hydroxyl group is normally 1,000 to 20,000, preferably 1,500 to 15,000, and more preferably 2,000 to 10,000. The mass average molecular mass thereof is normally 2,000 to 50,000, preferably 3,000 to 30,000, and more preferably 4,000 to 20,000.

The hydroxyl value of the polyester having a hydroxyl group is normally 5 to 120, preferably 7 to 70, and more preferably 10 to 60. The acid value thereof is normally 10 or less, preferably 5 or less, more preferably 2 or less.

Examples of the polyisocyanate include aromatic polyisocyanates having 6 to 20 carbon atoms (which here and hereinafter do not include carbon atoms in the NCO group), aliphatic polyisocyanates having 2 to 18 carbon atoms, alicyclic polyisocyanates having 4 to 15 carbon atoms, aromatic-aliphatic polyisocyanates having 8 to 15 carbon atoms, modified products of these polyisocyanates (for example, those containing groups such as an urethane group, carbodiimide group, allophanate group, urea group, biuret group, uretdione group, uretimine group, isocyanurate group and oxazolidone group), and combinations of these compounds.

Specific examples of the aromatic polyisocyanates include 1,3-phenylene diisocyanate, 1,4-phenylene diisocyanate, 2,4-tolylene diisocyanate (TDI), 2,6-tolylene diisocyanate, crude TDI, 2,4'-diphenylmethane diisocyanate (MDI), 4,4'-diphenylmethane diisocyanate, crude MDI [a phosgenated product of crude diaminophenylmethane, such as a condensation product of formaldehyde and an aromatic amine (aniline) or a mixture thereof; a mixture of diaminodiphenylmethane and a small amount (for example 5% by mass to 20% by mass) of a trifunctional or higher polyamine: polyallyl polyisocyanate (PAPI)], 1,5-naphthylene diisocyanate, 4,4',4"-triphenylmethane triisocyanate, m-isocyanatophenylsulfonyl isocyanate and p-isocyanatophenylsulfonyl isocyanate.

Specific examples of the aliphatic polyisocyanates include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, 2-isocyanatoethyl-2,6-diisocyanatohexanoate.

Specific examples of the alicyclic polyisocyanates include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate and 2,6-norbornane diisocyanate.

Specific examples of the aromatic-aliphatic polyisocyanates include m-xylylene diisocyanate (XDI), p-xylylene diisocyanate and $\alpha,\alpha,\alpha',\alpha'$-tetramethylxylylene diisocyanate (TMXDI).

The modified products of the polyisocyanates include modified MDI (such as urethane-modified MDI, carbodiimide-modified MDI, and trihydro carvyl phosphate modified MDI), urethane-modified TDI, and combinations of these compounds, for example a combination of modified MDI and urethane-modified TDI (isocyanate-containing prepolymer). Among these, aromatic polyisocyanates having 6 to 15 carbon atoms, aliphatic polyisocyanates having 4 to 12 carbon atoms, and alicyclic polyisocyanates having 4 to 15 carbon atoms are preferable, and TDI, MDI, HDI, hydrogenated MDI, and IPDI are particularly preferable.

Particles are formed in an aqueous phase by using a toner composition liquid containing the polymer and the colorant, then the ingredients are reacted with an amine, etc. to produce a polyester elongation reaction.

Examples of the amine include diamines, trivalent to hexavalent or higher amines, polyamines, amino alcohols, aminomercaptans, amino acids, and products each obtained by blocking an amino group of any of these compounds. Examples of the diamines include aromatic diamines having 6 to 23 carbon atoms, such as phenylenediamine, diethyltoluenediamine and 4,4'-diaminodiphenylmethane; alicyclic diamines having 5 to 20 carbon atoms, such as 4,4'-diamino-3,3'-dimethyldicyclohexylmethane, diaminocyclohexane and isophoronediamine; aliphatic diamines having 2 to 18 carbon atoms, such as ethylenediamine, tetramethylenediamine and hexamethylenediamine. Examples of the trivalent to hexavalent or higher amines and the polyamines include diethylenetriamine and triethylenetetramine. Examples of the amino alcohols include amino alcohols having 2 to 12 carbon atoms, specifically ethanolamine and hydroxyethylaniline. Examples of the aminomercaptans include aminomercaptans having 2 to 12 carbon atoms, specifically aminoethyl mercaptan and aminopropyl mercaptan.

Examples of the amino acids include amino acids having 2 to 12 carbon atoms, specifically aminopropionic acid and aminocaproic acid.

Examples of the products each obtained by blocking an amino group of any of these compounds include oxazoline compounds and ketimine compounds obtained by combining the amines with ketones having 3 to 8 carbon atoms (such as acetone, methyl ethyl ketone and methyl isobutyl ketone).

Among these amines, 4,4'-diaminodiphenylmethane, isophoronediamine and ethylenediamine are particularly preferable, more preferably products each obtained by blocking an amino group of any of these amines.

Further, it is possible to adjust the molecular mass of a urea-modified polyester using a reaction terminator in accordance with the necessity. Examples of the reaction terminator include monoamines (such as diethylamine, dibutylamine, butylamine and laurylamine), and products (ketimine compounds) each obtained by blocking any of these monoamines.

As for the ratio of any of the amines to the prepolymer having an isocyanate group, the equivalence ratio [NCO]/[NHx] of the isocyanate group [NCO] in the prepolymer having an isocyanate group to the amino group [NHx] in the amine (b) is normally in the range of 1/2 to 2/1, preferably in the range of 1.5/1 to 1/1.5, and more preferably in the range of 1.2/1 to 1/1.2.

The length of time of elongation reaction and/or cross-linking reaction is selected according to the reactivity between the isocyanate group structure of the prepolymer and the amine and is normally 10 min to 40 hr, and preferably 2 hr to 24 hr. The reaction temperature is normally 0° C. to 150° C., preferably 40° C. to 98° C. Additionally, a known catalyst may be used in accordance with the necessity.

To remove the organic solvent from the emulsified dispersion obtained, it is possible to employ a method of gradually raising the temperature of the entire system and completely removing the organic solvent in the droplets by evaporation. Also, fine toner particles may be formed by spraying the emulsified dispersion into a dry atmosphere and completely removing a non-water-soluble organic solvent in the droplets, and an aqueous dispersant may be removed at the same time by evaporation. For the dry atmosphere into which the emulsified dispersion is sprayed, a gas obtained by heating air, nitrogen, carbonic acid gas, combustion gas, etc. is generally used, particularly a gas stream heated to a temperature which is higher than or equal to the boiling point of the highest boiling point solvent used. With the use of a spray dryer, a belt dryer, a rotary kiln or the like, desired quality can be achieved by a short-time treatment.

When the particle size distribution is wide at the time of emulsification and dispersion, and washing and drying are carried out with that particle size distribution kept, it is possible to adjust the particle size distribution to a desired particle size distribution by classification.

As to the classification, fine particles can be removed by means of a cyclone, decanter, centrifugal separation, etc. in liquid. Classification may, of course, be carried out after particles have been obtained as powder through drying; nevertheless, it is desirable in terms of efficiency that classification be carried out in liquid.

As devices for the drying, through-flow dryers, spray dryers, rotary dryers, pneumatic conveying dryers, fluid-bed dryers, heat-transfer heating dryers, freeze dryers and the like are known, and any of these can be used.

Additionally, wax may be used in any production method employed in the present invention.

The wax used in the present invention is not particularly limited and may be suitably selected from commonly used waxes. Examples of the waxes include aliphatic hydrocarbon waxes such as low-molecular-mass polyethylene, low-molecular-mass polypropylene, polyolefin waxes, microcrystalline waxes, paraffin waxes and Sasol wax; oxides and block copolymers of aliphatic hydrocarbon waxes such as oxidized polyethylene waxes; vegetable waxes such as candelilla waxes, carnauba waxes, Japan waxes and jojoba waxes; animal waxes such as beeswaxes, lanolin and whale waxes; mineral waxes such as ozocerite, ceresin and petrolatum; waxes composed mainly of fatty acid esters, such as montanic acid ester waxes and castor waxes; and compounds each obtained by deoxidizing a part or whole of a fatty acid ester, such as deoxidized carnauba waxes.

Additional examples of the waxes include saturated straight-chain fatty acids such as palmitic acid, stearic acid, montanic acid, and straight-chain alkylcarboxylic acids having straight-chain alkyl groups; unsaturated fatty acids such as prandinic acid, eleostearic acid and valinaphosphoric acid; saturated alcohols such as stearyl alcohol, eicosyl alcohol, behenyl alcohol, carnaubyl alcohol, ceryl alcohol, mesilyl alcohol and long-chain alkyl alcohols; polyhydric alcohols such as sorbitol; fatty acid amides such as linoleic acid amide, olefinic acid amide and lauric acid amide; saturated fatty acid bisamides such as methylenebiscapric acid amide, ethylenebislauric acid amide and hexamethylenebisstearic acid amide; unsaturated fatty acid amides such as ethylenebisoleic acid amide, hexamethylenebisoleic acid amide, N,N'-dioleyladipic acid amide and N,N'-dioleylsebacic acid amide; aromatic bisamides such as m-xylenebisstearic acid amide and N,N-distearylisophthalic acid amide; fatty acid metal salts such as calcium stearate, calcium laurate, zinc stearate and magnesium stearate; waxes each obtained by grafting a wax which is based upon an aliphatic hydrocarbon, using a vinyl monomer such as styrene or acrylic acid; partial ester compounds each composed of a polyhydric alcohol and a fatty acid such as monoglyceride behenate; and hydroxyl group-containing methyl ester compounds each obtained by hydrogenating a vegetable oil or fat.

More suitable examples thereof include polyolefins produced by radically polymerizing olefins under high pressure; polyolefins each produced by refining a low-molecular-mass by-product obtained at the time of polymerization for a high-molecular-mass polyolefin; polyolefins produced by polymerization under low pressure, using a catalyst such as a Ziegler catalyst or a metallocene catalyst; polyolefins produced by polymerization, utilizing a radiant ray, an electromagnetic wave or light; low-molecular-mass polyolefins obtained by pyrolyzing high-molecular-mass polyolefins; paraffin waxes, microcrystalline waxes, Fischer-Tropsch waxes, synthetic hydrocarbon waxes synthesized in accordance with Synthol method, hydrocoal method or Arge method, synthetic waxes each containing as a monomer a compound which has one carbon atom, and hydrocarbon waxes each having a functional group such as hydroxyl group or carboxyl group; mixtures each composed of a hydrocarbon wax and a functional group-containing hydrocarbon wax; and waxes produced by graft-modifying these waxes with a vinyl monomer such as styrene, a maleic acid ester, an acrylate, a methacrylate or maleic anhydride.

Also, suitable examples thereof further include waxes obtained by subjecting these waxes to a press sweating method, a solvent method, a recrystallization method, a vacuum distillation method, a supercritical gas extraction method or a solution crystallization method to have sharp molecular mass distributions; and waxes obtained by removing low-molecular-mass solid fatty acids, low-molecular-mass solid alcohols, low-molecular-mass solid compounds or other impurities from these waxes.

It is desirable in view of balancing toner-fixing property and offset resistance that the melting point of the wax be 70° C. to 140° C., more desirably 70° C. to 120° C. When the melting point is lower than 70° C., there may be a decrease in blocking resistance. When the melting point is higher than 140° C., an offset-resistant effect may not be sufficiently exhibited.

Use of two or more different types of waxes together makes it possible to simultaneously exhibit a plasticizing effect and a releasing effect, which are effects of waxes.

Examples of waxes having plasticizing effects include waxes having low melting points, specifically waxes each having a branched chain or a polar group in its molecular structure.

Examples of waxes having releasing effects include waxes having high melting points, specifically waxes each having in its molecular structure a straight chain or having no functional group and thus no polarity. Examples of combinations of waxes for use include a combination of two or more different types of waxes that are different from one another by 10° C. to 100° C. in melting point, and a combination of a polyolefin and a graft-modified polyolefin.

As to the selection of two types of waxes, relatively speaking, when these waxes have similar compositions, a wax having a low melting point exhibits a plasticizing effect and a wax having a high melting point exhibits a releasing effect. On this occasion, when the difference in melting point is 10° C. to 100° C., functional separation can be effectively performed. When the difference in melting point is less than 10° C., an effect of functional separation may not be sufficiently exhibited. When the difference in melting point is greater than 100° C., functions derived from the interaction between the waxes may not be fully performed. On this occasion, one of the waxes preferably has a melting point of 70° C. to 120° C., more preferably 70° C. to 100° C., because an effect of functional separation tends to be easily exhibited if so.

As to the combination of waxes, relatively speaking, a wax which has a branched-chain structure or a polar group such as a functional group or is modified with a component different from its main component exhibits a plasticizing effect, and a wax which has a straight-chain structure or has no functional group and thus no polarity, or which has an unmodified straight structure exhibits a releasing effect. Suitable examples of the combination of waxes include a combination of a polyethylene homopolymer/copolymer composed mainly of ethylene, and a polyolefin homopolymer/copolymer composed mainly of an olefin other than ethylene; a combination of a polyolefin and a graft-modified polyolefin; a combination of an alcohol wax, a fatty acid wax or an ester wax, and a hydrocarbon wax; a combination of a Fischer-Tropsch wax or a polyolefin wax, and a paraffin wax or a microcrystalline wax; a combination of a Fischer-Tropsch wax and a polyolefin wax; a combination of a paraffin wax and a microcrystalline wax; and a combination of a carnauba wax, a candelilla wax, a rice wax or a montan wax, and a hydrocarbon wax.

In any case, it is desirable that the peak top temperature of the maximum peak lie in the temperature range of 70° C. to 110° C. and more desirable that the maximum peak lie in the temperature range of 70° C. to 110° C. regarding an endothermic peak observed in a DSC measurement of toner because it becomes easier to balance toner storage stability and toner-fixing property.

The total amount of the wax contained is preferably 0.2 parts by mass to 20 parts by mass, more preferably 0.5 parts by mass to 10 parts by mass, per 100 parts by mass of the binder resin.

In the present invention, the melting point of the wax is defined as the peak top temperature of the maximum peak in the endothermic peak of the wax measured in a DSC measurement.

As for the DSC measuring unit for the wax or the toner, a high-precision internal combustion input compensation type of differential scanning calorimeter is preferably used for the measurement. The endothermic peak measurement is performed in a manner compliant with ASTM D3418-82. As for the DSC curve used in the present invention, the temperature of the wax or the toner is raised once and lowered to record the temperature history, and then the DSC curve measured when the temperature of the wax or the toner is raised at 10° C./m is used.

In the present invention, the charge controlling agent, which is generally used in an electrophotographic toner, can be used with the binder resin and colorant.

When a colored material is used for the charge controlling agent, the toner may show different tones of color and, therefore, colorless materials or materials close to white are preferably used. Examples of charge controlling agents include metal complex dyes, fluorine-modified quaternary ammonium salts, metal salts of salicylic acid, and metal salts of salicylic acid derivatives. In addition, the metals can be appropriately selected depending on the intended purpose. Examples of the metals include aluminum, zinc, titanium, strontium, boron, silicon, nickel, iron, chrome, and zirconium.

For the charge controlling agent, commercially available products may be used. Examples thereof include Bontron E-82 of an oxynaphthoic acid metal complex, Bontron E-84 of a salicylic acid metal complex, and Bontron E-89 of a phenol condensate (manufactured by Orient Chemical Industries, Ltd.); LRA-901, and LR-147 of a boron metal complex (manufactured by Japan Carlit Co., Ltd.); quinacridones; azo pigments; and high-molecular mass compounds having sulfonic acid, carboxylic acid and a quaternary ammonium salt.

The amount of the charge controlling agent in the toner can be appropriately determined depending on the types of the binder resins, presence or absence of additives used as necessary, and the toner production method including dispersing process and thus is not unequivocally defined. The charge controlling agent is preferably added in an amount of 0.1 parts by mass to 10 parts by mass, and more preferably 0.2 parts by mass to 5 parts by mass per 100 parts by mass of the binder resin. When the amount of the charge controlling agent is more than 10 parts by mass, the effect of main charge controlling agent is reduced due to the excessive electrostatic property of the toner, and the electrostatic attraction force to the developing roller used may be increased to cause a degradation in fluidity of the developer and a decrease in image density.

These charge controlling agents and releasing agents may be melted and kneaded together with the masterbatch and resins or may be added when they are dissolved and dispersed in an organic solvent. It is preferred that the charge controlling agent is finely pulverized using a pulverizer such as a bead mill and dispersed previously in an organic solvent.

Examples of magnetic materials which are usable in the present invention include (1) magnetic iron oxides such as magnetite, maghemite, and ferrite, and iron oxides containing other metal oxides; (2) metals such as iron, cobalt, and nickel, or alloys of these metals with metals such as aluminum, cobalt, copper, lead, magnesium, tin, zinc, antimony, beryllium, bismuth, cadmium, calcium, manganese, selenium, titanium, tungsten, and vanadium; and (3) mixtures thereof.

Specific examples of the magnetic materials include ferrosoferric oxide ($Fe_3O_4$), γ-iron sesquioxide (γ-$Fe_2O_3$), $ZnFe_2O_4$, $Y_3Fe_5O_{12}$, $CdFe_2O_4$, $Gd_3Fe_5O_{12}$, $CuFe_2O_4$, $PdFe_{12}O$, $NiFe_2O_4$, $NdFe_2O$, $BaFe_{12}O_{19}$, $MgFe_2O_4$, $MnFe_2O_4$, $LaFeO_3$, iron powders, cobalt powders, and nickel powders. These magnetic materials may be used alone or in combination. Of these, fine powders of ferrosoferric oxides, and γ-iron sesquioxides are preferably used.

In addition, magnetic iron oxides such as magnetite, maghemite, and ferrite each containing different elements, and mixtures thereof may be used. Examples of the different elements include lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, and gallium. The preferred different elements are selected from magnesium, aluminum, silicon, phosphorus, and zirconium. Each of these different elements may be taken in crystal lattice of an iron oxide, or may be taken in an iron oxide as an oxide, or may exist as an oxide or a hydroxide on the surface of an iron oxide, and preferably, each of these different elements is contained as an oxide.

Salts of these different elements may be mixed in the each of these different elements in the course of producing the magnetic material and subjected to a pH adjustment to thereby be taken in particles of the iron oxide. In addition, after particles of the magnetic material are prepared, the each of these different elements may be precipitated on particle surfaces of the iron oxide by subjecting the each of these different elements to a pH adjustment or by adding salts of each of these elements and subjecting them to a pH adjustment.

The amount of the magnetic materials is preferably 10 parts by mass to 200 parts by mass and more preferably 20 parts by mass to 150 parts by mass per 100 parts by mass of the binder resin. The number average particle diameter of these magnetic materials is preferably 0.1 μm to 2 μm, and more preferably 0.1 μm to 0.5 μm. The number average particle diameter can be determined by measuring a photograph magnified by use of a transmission electron microscope using a deditizer.

The magnetic properties of the magnetic materials preferably have magnetic properties of an anti-magnetic force of 20 oersted to 150 oersted, a saturated magnetization of 50 emu/g to 200 emu/g, and a remanent magnetization of 2 emu/g to 20 emu/g under application of 10K oersted are preferably used.

The glass transition temperature (Tg) of the binder resin can be appropriately selected depending on the intended purpose. The glass transition temperature of the binder resin is preferably 30° C. to 120° C., and more preferably 40° C. to 70° C. When the glass transition temperature is lower than 30° C., the storage stability of toner may be decreased. When the glass transition temperature is higher than 120° C., the low-temperature fixing property may be insufficient.

The glass transition temperature (Tg) as used herein is determined in the following manner using TA-60WS and DSC-60 (manufactured Shimadzu Corp.) as a measuring device under the conditions described below.

[Measurement Conditions]

Sample container: aluminum sample pan (with a lid)
Sample amount: 5 mg
Reference: aluminum sample pan (10 mg of alumina)
Atmosphere: nitrogen (flow rate: 50 ml/min)
Temperature condition:
Start temperature: 20° C.
Heating rate: 10° C./min
Finish temperature: 150° C.
Hold time: 0
Cooling rate: 10° C./min
Finish temperature: 20° C.
Hold time: 0
Heating rate: 10° C./min
Finish temperature: 150° C.
Measurement results are analyzed using date analysis software (TA-60, version 1.52, Shimadzu Corp.). The glass transition temperature is determined from DrDSC curve—a DSC transition curve for the second heating operation—by a glass transition temperature analysis function of the device. In the present invention the first shoulder portion of the graph, where glass transition starts, is defined as the glass transition temperature.

The thus obtained toner may be added with external additives such as a fluidity improving agent, a cleaning ability improving agent, and the like. The fluidity improving agent is incorporated onto the surface of the toner to improve the fluidity, namely to make the toner easy to flow.

Examples of the fluidity improving agent include carbon black; fluoride resin powders such as fluorinated vinylidene fine powders, and polytetrafluoroethylene fine powders; silica fine powders such as wet-process silicas, dry-process silicas; titanium oxide fine powders, alumina fine powders, and surface-treated silicas of which the silica fine powder, the titanium oxide fine powder or the alumina fine powder is subjected to a surface treatment using a silane coupling agent, a titanium coupling agent, or a silicone oil; surface-treated titanium oxide fine powders, and surface-treated aluminas. Of these, silica fine powders, titanium oxide fine powders, and alumina fine powders are preferably used. Treated silicas of which the silica fine powder, the nonoxidized titanium fine powder or the alumina fine powder is subjected to a surface treatment using a silane coupling agent or a silicone oil are more preferably used.

With respect to the particle diameter of the fluidity improving agent, the fluidity improving agent has a primary average particle diameter of preferably 5 nm to 500 nm, and more preferably 7 nm to 120 nm.

The silica fine powers are fine powers produced by vapor-phase oxidation of a silicon-halogen compound and referred to as so-called dry-process silica or fumed silica.

Examples of commercially available silica fine powers produced by vapor-phase oxidation of a silicon-halogen compound include AEROSIL-130, AEROSIL-300, AEROSIL-380, AEROSIl-TT600, AEROSIL-MOX170, AEROSIL-MOX80, and AEROSIL-COK84 (manufactured by NIPPON AEROSIL CO., LTD.); Ca-O-SiL-M-5, Ca-O-SiL-MS-7, Ca-O-SiL-MS75, Ca-O-SiL-HS-5, and Ca-O-SiL-EH-5 (manufactured by CABOT Corp.); Wacker HDK-N20, Wacker HDK-V15, Wacker HDKV-N20E, Wacker HDK-T30, and Wacker HDK-T40 (manufactured by WACKER-CHEMIE GMBH); D-CFine Silica (manufactured by Dow Corning Co., Ltd.); and FRANSOL (manufactured by Fransil Sa).

Further, hydrophobized silica fine powers produced by hydrophobizing silica fine powder produced by vapor-phase oxidation of a silicon halogen compound are more preferably used. For the hydrophobized silica fine powders, since the hydrophobization degree of hydrophobized silica fine powers measured in methanol titration test is 30% to 80%, hydrophobized silica fine powders are particularly preferable. Hydrophobization is given by chemically or physically treating silica fine powder with an organic silicon compound capable of reacting with or physically absorbing silica fine powder. As a preferred hydrophobization, it is preferable to employ a method in which a silica fine powder produce by vapor-phase oxidation of a silicon halogen compound is hydrophobized with an organic silicon compound.

Examples of the organic silicon compound include hydroxypropyltrimethoxysilane, phenyltrimethoxysilane, n-hexadecyltrimethoxysilane, n-octadecyltrimethoxysilane, vinylmethoxysilane, vinyltriethoxysilane, vinyltriacetoxysilane, dimethylvinylchlorosilane, divinylchlorosilane, γ-methacryloxypropyltrimethoxysilane, hexamethyldisilane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chlorethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexymethyldisiloxane, 1,3-divinyltetramethyldisiloxane, 1,3-diphenyltetramethyldisiloxane, and dimethylpolysiloxane having 2 to 12 siloxanes per molecule and containing 0 to 1 hydroxyl group which is bound to Si at each of the terminals of the siloxanes, and further include silicone oils such as dimethylsilicone oil. These may be used alone or in combination.

The number average particle diameter of the fluidity improving agent is preferably 5 nm to 100 nm, and more preferably 5 nm to 50 nm.

The specific surface area of the fluidity improving agent based on nitrogen absorption measured by BET method is preferably 30 $m^2/g$ or more, and more preferably 60 $m^2/g$ to 400 $m^2/g$. The specific surface area of a surface-treated fine powder based on nitrogen absorption measured by BET method is preferably 20 $m^2/g$ or more, and more preferably 40 $m^2/g$ to 300 $m^2/g$.

The amount of these fine powders is preferably 0.03 parts by mass to 8 parts by mass per 100 parts by mass of toner particles.

A cleaning ability improving agent is added to the toner to remove a developer remaining on a photoconductor and on a primary transferring member after a transferring step. Examples thereof include fatty acid metal salts such as zinc stearate, calcium stearate, stearic acid; fine polymer particles prepared by soap-free emulsion polymerization such as polymethylmethacrylate fine particles and polystyrene fine particles; polymer particles such as silicone, benzoguanamine, and nylon. Among these, polymer particles having a relatively narrow particle size distribution and a volume-average particle diameter of 0.01 μm to 1 μm are preferable.

To the toner of the present invention, other additives can be suitably added in accordance with the necessity, for the purpose of protecting latent electrostatic image bearing member and carrier, improving cleaning ability, controlling thermal property, electric property, and physical property, controlling resistance property, controlling softening point, and improving fixing rate. Examples of the other additives include various metal soaps, fluoride surfactants, dioctyl phthalate; conductivity imparting agents such as tin oxides, zinc oxides, carbon black, and antimony oxides; and inorganic fine powders such as titanium oxides, aluminum oxides, and aluminas. These inorganic fine powders may be hydrophobized as necessary. In addition, it is possible to use a small amount of lubricant such as polytetrafluoroethylene, zinc stearate, and polyfluorovinylidene; and abrasive such as cesium oxides, silicon carbides, and strontium titanate; and caking protecting agents. Besides, white fine particles and black fine particles having a reverse polarity to that of toner particles can be further added as developing property improving agent.

It is also preferable that each of these additives is treated with treatment agents such as silicone varnish, various types of modified-silicone varnish, silicone oil, various types of silicone oil, silane coupling agent, silane coupling agent having a functional group, treatment agents such as other organic silicon compounds or other types of treatment agents, for the purpose of controlling the charge amount of the toner.

As the toner obtained according to the present invention has an outstandingly uniform particle diameter, the fluidity of a toner base particle is significantly high. Therefore, when external additives are added to decrease adhesion to a production apparatus and the like, an extremely small amount of the external additives can exhibit its effect. It is preferred that these external additives are used as less as possible, in view of degradation of the additives due to stress, safety of fine particles which influences to human body. The used of small amount of external additives is also advantages of the present invention.

(Toner)

The toner of the present invention is a toner produced by the above-mentioned toner production method of the present invention. The ratio of a mass average particle diameter to a number-average particle diameter in the toner (mass average particle diameter/number average particle diameter) is preferably 1.00 to 1.15, and more preferably 1.00 to 1.10. The mass average particle diameter is preferably 1 μm to 6 μm.

The shape and size of the toner are not particularly limited and may be appropriately selected depending on the intended purpose. The toner preferably has the following average circularity, mass average particle diameter, ratio of mass average particle diameter to number average particle diameter (mass average particle diameter/number average particle diameter), and the like.

The average circularity is a value obtained by dividing the circumference of a circle that has the same area as an actual projected area of a toner particle by the circumference of that toner particle. It may be preferably 0.900 to 0.980, and more preferably 0.950 to 0.975. Note that it is preferable that the proportion of particles having the average circularity of less than 0.940 be 15% or less of the total particles.

When the average circularity is less than 0.900, transfer properties may be unsatisfied and toner dust-free high quality images may not be obtained. When the average circularity is more than 0.980, cleaning failures may occur on a photoconductor and transfer belt in an image-forming system equipped with a cleaning blade, causing smears on images. For example, in a case of formation of an image that occupies a large area of a sheet (e.g., photographic images), background smears may occur, because, when paper feed failure or the like occurs, toner particles that have been used to develop the image remains unremoved and accumulates on the photoconductor, or, in that case, a charging roller which provides charges to the photoconductor in contact therewith becomes contaminated by residual toner particles and thus its original charge ability may be impaired.

The average circularity can be measured, for example, using a flow particle image analyzer (FPIA-2000, manufactured by Sysmex Corp.).

Measurements is performed in the following manner. Tiny dusts in water are first moved by filtration so that the number of particles to be measured (e.g., circle equivalent diameter of 0.60 μm or more to less than 159.21 μm) is 20 or less per $10^{-3}$ $cm^3$ of water, followed by addition of a few droplets of non-ionic surfactant (preferably "Contaminon N" manufactured by Wako Pure Chemical Industries, Ltd.) and 5 mg of sample to 10 ml of the water. The mixture is then dispersed using a distributed machine (UH-50, produced by SMT Co., Ltd.) for 1 minute at 20 kHz and 50 W/10 $cm^3$. Further, the dispersion treatment was performed for a 5 minutes in total, preparing a sample solution with a particle concentration of $4{,}000/10^{-3}$ to $8{,}000/10^{-3}$ $cm^3$ (particles having a circle equivalent diameter of 0.60 μm or more to less than 159.21 μm). The particle size distribution of these particles is then determined as follows.

The sample solution is allowed to flow through a flat, transparent flow cell (thickness: about 200 μm) that extends in the flow direction. A flash lamp and a CCD camera are arranged on opposite sides of the flow cell to establish an optical path that crosses the flow cell. While the sample solution is running, a strobe light flashes at 1/30-second intervals to obtain a 2D image of each particle in the flow cell at a parallel range. By calculating the diameter of a circle that has the same area as the 2D image, the circle equivalent diameter of the particle is determined.

The circle equivalent diameters of 1,200 or more particles can be determined in about 1 minute, and the number and proportion (number-based %) of particles having a specified circle equivalent diameter can be determined on the basis of the circle equivalent diameter distribution. Measurement results (frequency % and accumulation %) can be obtained by dividing a particle size range (0.06 μm to 400 μm) into 226 channels (30 channels per octave). In actual measurements, particles having a circle equivalent diameter of 0.60 μm or more to less than 159.21 μm are subjected to measurements.

The mass average particle diameter and particle size distribution of toner particles can be measured by the Coulter Counter method, using Coulter Counter TA-II and COULTER MULTISIZER II (both are manufactured by Coulter). A measurement method will be described below.

First, as a dispersant, 0.1 ml to 5 ml of a surfactant (alkylbenzen sulfonate) is added to 100 ml to 150 ml of an electrolytic aqueous solution. Here, the electrolytic solution is an approximately 1 mass % NaCl aqueous solution prepared using primary sodium chloride, for example, ISOTON-II (by Beckmann Coulter Inc.). Subsequently, 2 mg to 20 mg of sample to be measured is further added. The electrolytic solution which is a suspended sample is sonicated for approximately 1 minute to 3 minutes using an ultrasonic dispersion device. By the measurement instrument using 100 μm-aperture, the mass and the number of toner particles are measured to find its mass distribution and number distribution, from which the mass average particle diameter (D4) and number average particle diameter (Dn) of the toner particles are obtained.

For channels, 13 different channels were used—from 2.00 μm or more to less than 2.52 μm; from 2.52 μm or more to less than 3.17 μm; from 3.17 μm or more to less than 4.00 μm; from 4.00 μm or more to less than 5.04 μm; from 5.04 μm or more to less than 6.35 μm; from 6.35 μm or more to less than 8.00 μm; from 8.00 μm or more to less than 10.08 μm; from 10.08 μm or more to less than 12.70 μm; from 12.70 μm or more to less than 16.00 μm; from 16.00 μm or more to less than 20.20 μm; from 20.20 μm or more to less than 25.40 μm; from 25.40 μm or more to less than 32.00 μm; and from 32.00 μm or more to less than 40.30 μm—targeting particles having a diameter of from 2.00 μm or more to less than 40.30 μm.

The mass average particle diameter of the toner is not particularly limited and may be appropriately selected depending on the intended purpose. The mass average particle diameter is preferably 1 μm to 6 μm.

When the mass average particle diameter is less than 1 μm, in a case of two-component developer, a toner may be melted and adhered to a carrier surface to decrease its charge ability as a result of a long-time stirring in a developing unit, and in a case of a one-component developer, toner filming may occur at a developing roller or a toner may more likely to be melted and adhered to members such as a blade due to the thinned layer of the toner. When the mass average particle diameter is more than 10 μm, it becomes difficult to obtain images of high resolution and high quality, and the toner particle diameter may largely vary when new toner is added to the developer to compensate the consumed toner.

The ratio of a mass average particle diameter to a number average particle diameter in a toner (mass average particle diameter/number average particle diameter) is preferably 1.00 to 1.10, and more preferably 1.00 to 1.05.

When this ratio exceeds 1.10, in a case of two-component developer, a toner may be melted and adhered to a carrier surface to decrease its charge ability as a result of a long-time stirring in a developing unit, and in a case of a one-component developer, toner filming may occur at a developing roller or a toner may more likely to be melted and adhered to members such as a blade because of its thinned layer of the toner. In addition, it becomes difficult to obtain images of high resolution and high quality, and the toner particle diameter may largely vary when toner is added to the developer to compensate the consumed toner.

In case where the amount of the additive for improving fluidity is decreased, when the ratio of a mass average particle diameter to a number average particle diameter (mass average particle diameter/number average particle diameter) exceeds 1.10, the fluidity may becomes poor and toner supplying ability from a toner container to a developing unit may be adversely affected.

The mass average particle diameter and the ratio of a mass average particle diameter to a number average particle diameter (mass average particle diameter/number average particle diameter) can be determined by measuring a toner using, for example, a particle size analyzer, COULTER COUNTER TA-II, manufactured by Coulter Electronics Ltd.

(Developer)

The developer used in the present invention contains at least the toner of the present invention and further contains appropriately selected other components such as a carrier. The developer may be either a one-component or a two-component developer; however, when it is applied to high-speed printers that support increasing information processing rates of recent years, a two-component developer is preferably used in view of achieving an longer life span.

In the case of a one-component developer containing the toner of the present invention, the variations in the toner particle diameter are minimized even after consumption or addition of toner, and toner filming to a developing roller and toner adhesion to members, such as a blade for decreasing layer thickness of the toner, are not occurred. Thus, it is possible to provide excellent and stable developing properties and images even after a long time usage (stirring) of the developing unit. Meanwhile, in the case of a two-component developer containing the toner of the present invention, even after many cycles of consumption and addition of toner, the variations in the toner particle diameter are minimized and, even after a long time stirring in the developing unit, excellent and stable developing properties may be obtained.

When the toner of the present invention may be mixed with a carrier and used as a two-component developer, typically used carrier such as ferrite and magnetite and resin-coated carrier can be used as the carrier.

The resin-coated carrier is composed of a carrier core particle and a coating agent which is a resin coating the surface of the core particle.

The material for the carrier core particle is not particularly limited and can be appropriately selected from conventional materials, for example, materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 emu/g to 120 emu/g) are preferable. In addition, weak magnetizing materials such as copper-zinc (Cu—Zn)-based materials (30 emu/g to 80 emu/g) are preferable from the standpoint for achieving higher-grade images by reducing the contact pressure against the photoconductor having standing toner particles. These materials may be used alone or in combination.

The particle diameter of the carrier core particle, in terms of volume average particle diameter, is preferably 10 μm to 150 μm, and more preferably 40 μm to 100 μm.

When the volume-average particle diameter is less than 10 μm, fine particles make up a large proportion of the carrier particle distribution, causing carrier scattering due to reduced magnetization per one particle in some cases, on the other hand, when it exceeds 150 μm, the specific surface area of the particle decreases, causing toner scatterings and reducing the reproducibility of images, particularly the reproducibility of solid images in full-color images because of many solid images in full-color images.

Materials for the resin layer are not particularly limited and can be appropriately selected from those known in the art depending on the intended purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and silicone resins. These resins may be used alone or in combination.

Examples of the amino resins include urea-formaldehyde resins, melamine resins, benzoguanamine resins, urea resins, polyamide resins, and epoxy resins. Examples of the polyvinyl resins include acrylic resins, polymethyl methacrylate resins, polyacrylonitrile resins, polyvinyl acetate resins, polyvinyl alcohol resins, and polyvinyl butyral resins. Examples of the polystyrene resins include polystyrene resins, and styrene-acryl copolymer resins. Examples of the halogenated olefin resins include polyvinyl chloride. Examples of the polyester resins include polyethylene terephthalate resins, and polybutylene terephthalate resins.

The resin layer may contain conductive powder and the like as necessary. Examples of the conductive powders include metal powder, carbon black, titanium oxide, tin oxide and zinc oxide. These conductive powders preferably have an average particle diameter of 1 μm or less. When the average particle diameter is greater than 1 μm, it may be difficult to control electrical resistance.

The resin layer may be formed by dissolving the silicone resin or the like into a solvent to prepare a coating solution, uniformly coating the surface of the core material with the coating solution by a known coating process, and drying and baking the core material. Examples of the coating processes include immersing process, and spray process.

The solvent is not particularly limited and can be appropriately selected depending on the intended purpose. Examples thereof include toluene, xylene, methyl ethyl ketone, methyl isobutyl ketone, cellosolve, and butylacetate.

The baking process is not particularly limited and may be an externally heating process or an internally heating process, and can be selected from, for example, a process using a fixed type electric furnace, a fluid type electric furnace, a rotary type electric furnace or a burner furnace, and a process using microwave and the like.

The amount of the resin layer in the carrier is preferably 0.01% by mass to 5.0% by mass. If the content is less than 0.01% by mass, it may be difficult to form a uniform resin layer on the surface of the core material, on the other hand, when the content exceeds 5.0% by mass, the resin layer becomes so thick that carrier particles may associate together. Thus, it may fail to obtain uniform carrier particles.

When the developer is a two-component developer, the amount of the carrier in the two-component developer is not particularly limited and can be appropriately determined depending on the intended purpose, for example, it is preferably 90% by mass to 98% by mass, more preferably 93% by mass to 97% by mass.

The developer contains the toner of the present invention, thus the developer exhibits excellent chargeability upon image formation and can stably form a high quality image.

(Toner Container)

The toner container used in the present invention is a container supplied with the toner or the developer of the present invention.

The toner container is not particularly limited and can be appropriately selected from conventional containers, for example, a toner container having a container main body and a cap is a suitable example.

The size, shape, structure, and material of the container main body are not particularly limited and can be appropriately determined depending on the intended purpose. For example, the container main body may preferably have a cylindrical shape, most preferably a cylindrical shape in which spiral grooves are formed on its inner surface that allow toner in the container to shift to the outlet along with rotation of the main body, and in which all or part of the spiral grooves have a bellow function.

Materials for the container main body are not particularly limited and may be preferably those capable of providing accurate dimensions when fabricated and examples include resins. Examples thereof include polyester resins, polyethylene resins, polypropylene resins, polystyrene resins, polyvinyl chloride resins, polyacrylic acid resins, polycarbonate resins, ABS resins, and polyacetal resins.

The toner container can be readily stored and transferred, and is easy to handle. The toner container can be suitably used to supply with toner by detachably attaching it to a process cartridge, image forming apparatus or the like, which will be explained later.

(Process Cartridge)

The process cartridge used in the present invention contains a latent electrostatic image bearing member configured to bear a latent electrostatic image, and a developing unit configured to develop the latent electrostatic image formed on the latent electrostatic image bearing member using a toner to thereby form a visible image, and further contains additional units appropriately selected.

The developing unit contains a developer container for containing the toner or the developer of the present invention, and a developer carrier for carrying and transferring the toner or developer contained in the developer container, and may further contains a layer-thickness control member for controlling the thickness of the layer of toner to be carried.

The process cartridge contains, for example, as shown in FIG. 1, a latent electrostatic image bearing member 701 mounted in, a charging unit 702, a developing unit 704, a transferring unit 708, and a cleaning unit 707 and, if necessary, further contains additional units. In FIG. 1, 703 denotes exposure light by means of an exposing unit, and 705 denotes a recording medium.

Next, an image forming process by means of the process cartridge shown in FIG. 1 will be described. The latent electrostatic image bearing member 701 rotates in the arrow direction, charged by means of the charging unit 702 and is exposed with the exposure light 703 by means of an exposing unit (not shown), whereby a latent electrostatic image corresponding to the exposed image is formed thereon. This electrostatic image is developed by means of the developing unit 704, and the resultant visible image is transferred to the recording medium 705 by means of the transferring unit 708. The recording medium 705 is then printed out. Subsequently, after transferring the image, the surface of the latent electrostatic image bearing member 701 is cleaned by means of the cleaning unit 707, and charges are removed by means of a charge-eliminating unit (not shown). This whole process is continuously repeated.

(Image Forming Method and Image Forming Apparatus)

The image forming method of the present invention includes at least a latent electrostatic image forming step, a developing step, a transferring step and a fixing step, and further contains additional steps such as a charge eliminating step, a cleaning step, a recycling step and a controlling step, which are appropriately selected as necessary.

The latent electrostatic image forming step is a step of forming a latent electrostatic image on the latent electrostatic image bearing member.

The material, shape, size, structure, and several features of the latent electrostatic image bearing member (also referred to as photoconductor) are not particularly limited and can be appropriately selected from those known in the art. However, a drum shaped-latent electrostatic image bearing member is a suitable example. For the material constituting the latent electrostatic image bearing member, inorganic photoconductive materials such as amorphous silicon and selenium, and organic photoconductive materials are preferable.

The formation of the latent electrostatic image is achieved by, for example, exposing the latent electrostatic image bearing member imagewisely after equally charging its entire surface. This step is performed by means of the latent electrostatic image forming unit. The latent electrostatic image forming unit may contain a charging unit configured to equally charge the surface of the latent electrostatic image bearing member, and an exposing unit configured to expose imagewisely the surface of the latent electrostatic image bearing member.

The charging step is achieved by, for example, applying voltage to the surface of the latent electrostatic image bearing member by means of the charging unit.

The charging unit is not particularly limited and can be appropriately selected depending on the intended purpose. Examples thereof include known contact-charging devices equipped with a conductive or semiconductive roller, blush, film or rubber blade, and known non-contact-charging devices utilizing corona discharge such as corotron or scorotron.

The exposing step is achieved by, for example, exposing the surface of the photoconductor imagewisely by means of an exposing unit.

The exposing unit is not particularly limited as long as it is capable of performing imagewise exposure on the surface of the charged latent electrostatic image bearing member by means of the charging unit, and may be appropriately selected depending on the intended use. Examples thereof include various exposing devices, such as optical copy devices, rod-lens-eye devices, optical laser devices, and optical liquid crystal shatter devices.

Note in the present invention that a backlight system may be employed for exposure, where imagewise exposure is performed from the back side of the latent electrostatic image bearing member.

—Developing and Developing Unit—

The developing step is a step of developing the latent electrostatic image using the toner or developer of the present invention to form a visible image.

The formation of the visible image can be achieved, for example, by developing the latent electrostatic image using the toner or the developer of the present invention. This is performed by means of the developing unit.

The developing unit is not particularly limited as long as it is capable of performing developing by means of the toner or the developer of the present invention, and can be appropriately selected from known developing units depending on the intended purpose. Suitable examples include those having at least a developing device, which is capable of housing the toner or the developer of the present invention therein and is capable of directly or indirectly applying the toner or developer to the latent electrostatic image. A developing device equipped with the toner container is more preferable.

The developing device may be designed either for monochrome or multiple-color. Suitable examples include those having a stirring device for stirring the toner or developer to provide electrical charges by frictional electrification, and a rotatable magnetic roller.

In the developing device the toner and carrier are mixed together and the toner is charged by friction, allowing the rotating magnetic roller to bear toner particles in such a way that they stand on its surface. In this way a magnetic blush is formed. Since the magnetic roller is arranged in the vicinity of the latent electrostatic image bearing member (photoconductor), some toner particles on the magnetic roller that constitute the magnetic blush electrically migrate to the surface of the latent electrostatic image bearing member (photoconductor). As a result, a latent electrostatic image is developed using the toner so as to form a visible image on the surface of the latent electrostatic image bearing member (photoconductor).

The developer contained in the developing device is a developer containing the toner of the present invention. The developer may be either a one-component developer or a two-component developer. The toner contained in the developer is the toner of the present invention.

—Transferring Step and Transferring Unit—

The transferring step is a step of transferring the visible image onto a recording medium. A preferred embodiment of transferring involves two steps: primary transferring in which a visible image is transferred onto an intermediate transfer member, and secondary transferring in which the visible image transferred onto the intermediate transfer member is transferred onto a recording medium. A more preferable embodiment of transferring involves two steps: primary transferring in which a visible image is transferred onto an intermediate transfer member to form a complex image thereon by means of toners of two or more different colors, preferably full-color toners; and secondary transferring in which the complex image is transferred onto a recording medium.

The transferring step is carried out by, for example, charging the intermediate transfer member or the recording medium by use of a transfer charger, and this can be carried out by the transfer unit. The transfer unit preferably includes a primary transfer unit that transfers a visible image onto an intermediate transfer member to form a composite transfer image and a secondary transfer unit that transfers the composite transfer image onto a recording medium.

The intermediate transfer member is not particularly limited and can be selected from conventional transferring media depending on the intended purpose; suitable examples include transferring belts.

The transferring unit (i.e., the primary and secondary transferring units) preferably contains a transferring device configured to charge and separate the visible image from the latent electrostatic image bearing member (photoconductor) and transfer it onto the recording medium. The number of the transferring unit to be provided may be either 1 or more.

Examples of the transferring devices include corona transferring devices utilizing corona discharge, transferring belts, transferring rollers, pressure-transferring rollers, and adhesion-transferring devices.

The recording medium is not particularly limited and can be appropriately selected from known recording media (recording sheets).

The fixing step is a step of fixing a transferred visible image onto a recording medium by means of the fixing unit. Fixing may be performed every time after each color toner has been transferred to the recording medium or may be performed in a single step after all different toners have been transferred to the recording medium.

The fixing unit is not particularly limited and can be appropriately selected depending on the intended purpose. Examples thereof include a heating-pressurizing unit which uses a known roller-shaped or belt-shaped fixing member. The heating-pressurizing unit is preferably a combination of a heating roller and a pressurizing roller, or a combination of a heating roller, a pressurizing roller, and an endless belt, for example.

In general, heating treatment by means of the heating-pressurizing unit is preferably performed at a temperature of 120° C. to 200° C.

Note in the present invention that a known optical fixing unit may be used in combination with or instead of the fixing step and fixing unit, depending on the intended purpose.

The charge eliminating step is a step of applying a bias to the charged latent electrostatic image bearing member for elimination of charges. This is suitably performed by means of the charge eliminating unit.

The charge eliminating unit is not particularly limited as long as it is capable of applying a charge eliminating bias to the latent electrostatic image bearing member, and can be appropriately selected from known charge eliminating units depending on the intended purpose. A suitable example thereof is a charge eliminating lamp and the like.

The cleaning step is a step of removing toner particles remaining on the latent electrostatic image bearing member. This is suitably performed by means of the cleaning unit.

The cleaning unit is not particularly limited as long as it is capable of eliminating such toner particles from the latent electrostatic image bearing member, and can be suitably selected from known cleaning units depending on the intended use. Examples thereof include a magnetic blush cleaner, an electrostatic brush cleaner, a magnetic roller cleaner, a blade cleaner, a blush cleaner, and a wave cleaner The recycling step is a step of recycling the toner particles removed through the cleaning step to the developing unit. This is suitably performed by means of a recycling unit.

The recycling unit is not particularly limited and can be appropriately selected from conventional conveyance systems.

One embodiment of the image forming method of the present invention by means of the image forming apparatus will be described with reference to FIG. 2. Image forming apparatus 800 shown in FIG. 2 includes a photoconductor drum 810 (hereinafter referred to as "photoconductor 810") as the latent electrostatic image bearing member, a charging roller 820 as the charging unit, an exposure unit 830 as the exposing unit, a developing unit 840 as the developing unit, an intermediate transfer member 850, a cleaning unit 860 as the cleaning unit having a cleaning blade, and a charge eliminating lamp 870 as the charge eliminating unit.

Intermediate transfer member 850 is an endless belt, and is so designed that it loops around three rollers 851 disposed its inside and rotates in the direction shown by the arrow by means of rollers 851. One or more of three rollers 851 also functions as a transfer bias roller capable of applying a certain transfer bias (primary bias) to the intermediate transfer member 850. A cleaning blade 890 is provided adjacent to the intermediate transfer member 850. There is provided a transferring roller 880 facing to the intermediate transfer member 850 as the transferring unit capable of applying a transfer bias so as to transfer a visible image (toner image) to a transfer medium 895 (secondary transferring). Moreover, there is provided a corona charger 858 around the intermediate transfer member 850 for applying charges to the toner image transferred on the intermediate transfer member 850. The corona charger 858 is arranged between the contact region of the photoconductor 810 and the intermediate transfer member 850 and the contact region of the intermediate transfer member 850 and the transfer medium 895, in the rotational direction of the intermediate transfer member 850.

A developing unit 840 includes a developing belt 841 as a developer bearing member, a black developing unit 845K, a yellow developing unit 845Y, a magenta developing unit 845M and a cyan developing unit 845C, these developing units being positioned around the developing belt 841. The black developing unit 845K contains a developer container 842K, a developer supplying roller 843K, and a developing roller 844K. The yellow developing unit 845Y contains a developer container 842Y, a developer supplying roller 843Y, and a developing roller 844Y. The magenta developing unit 845M contains a developer container 842M, a developer supplying roller 843M, and a developing roller 844M. The cyan developing unit 845C contains a developer container 842C, a developer supplying roller 843C, and a developing roller 844C. The developing belt 841 is an endless belt looped around a plurality of belt rollers so as to be rotatable. A part of the developing belt 841 is in contact with the photoconductor 810.

Figure 2:
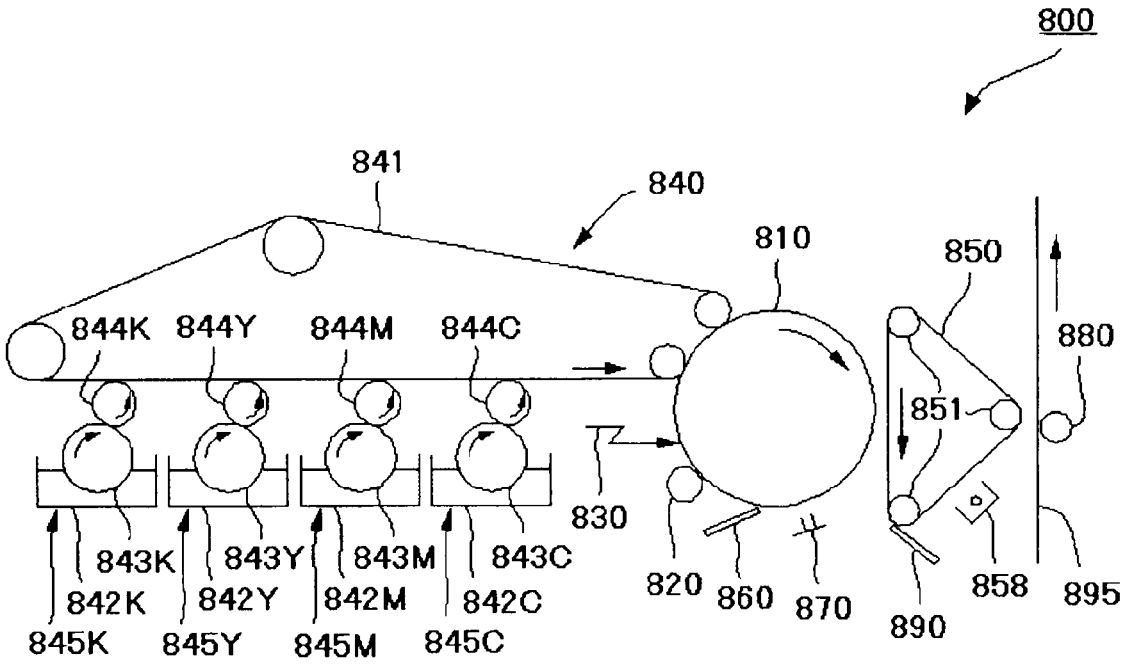
FIG. 2 is a schematic explanatory diagram showing an example of an image forming apparatus used in an image forming method of the present invention.

In image forming apparatus 800 shown in FIG. 2, the photoconductor drum 810 is uniformly charged by means of, for example, the charging roller 820. The exposure unit 830 then exposes imagewisely on the photoconductor drum 810 so as to form a latent electrostatic image. The latent electrostatic image formed on the photoconductor drum 810 is provided with toner from the developing unit 840 to form a visible image (toner image). The roller 851 applies a bias to the toner image to transfer the visible image (toner image) onto the intermediate transfer member 850 (primary transferring), and further applies a bias to transfer the toner image from the intermediate transfer member 850 to the transfer sheet 895 (secondary transferring). In this way a transferred image is formed on the transfer sheet 895. Thereafter, toner particles remaining on the photoconductor drum 810 are removed by means of the cleaning unit 860, and charges of the photoconductor drum 810 are removed by means of a charge eliminating lamp 870 on a temporary basis.

Figure 3:
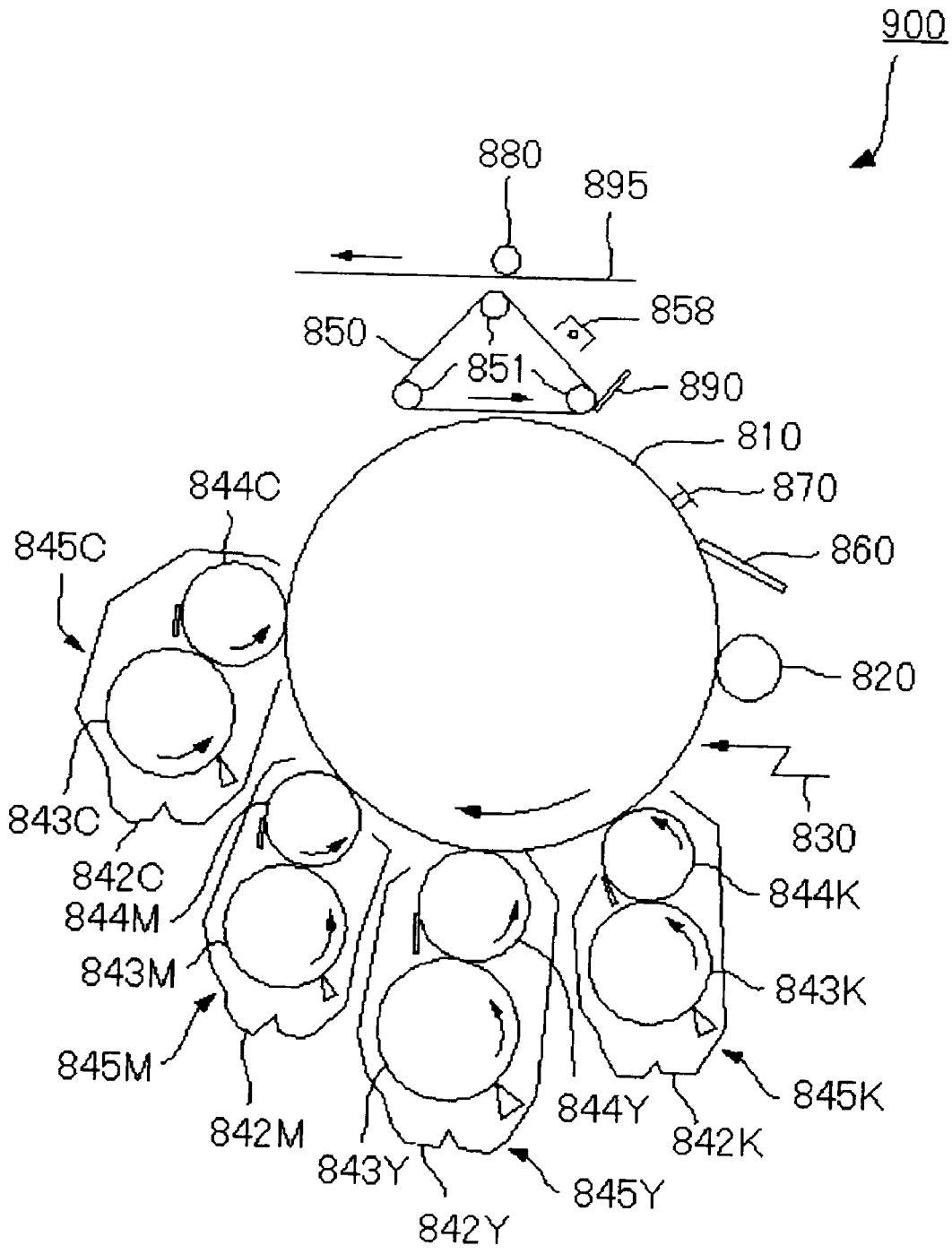
FIG. 3 is a schematic explanatory diagram showing another example of an image forming apparatus used in an image forming method of the present invention.

Another embodiment of the image forming method of the present invention by means of the image forming apparatus will be described with reference to FIG. 3. The image forming apparatus 900 shown in FIG. 3 has an identical configuration and working effects to those of the image forming apparatus 800 shown in FIG. 2 except that this image forming apparatus 800 does not contains the developing belt 841 and that the black developing unit 845K, yellow developing unit 845Y, magenta developing unit 845M and cyan developing unit 845C are disposed so as to face the photoconductor 810. Note in FIG. 3 that members identical to those in FIG. 2 are denoted by the same reference numerals.

Figure 4:
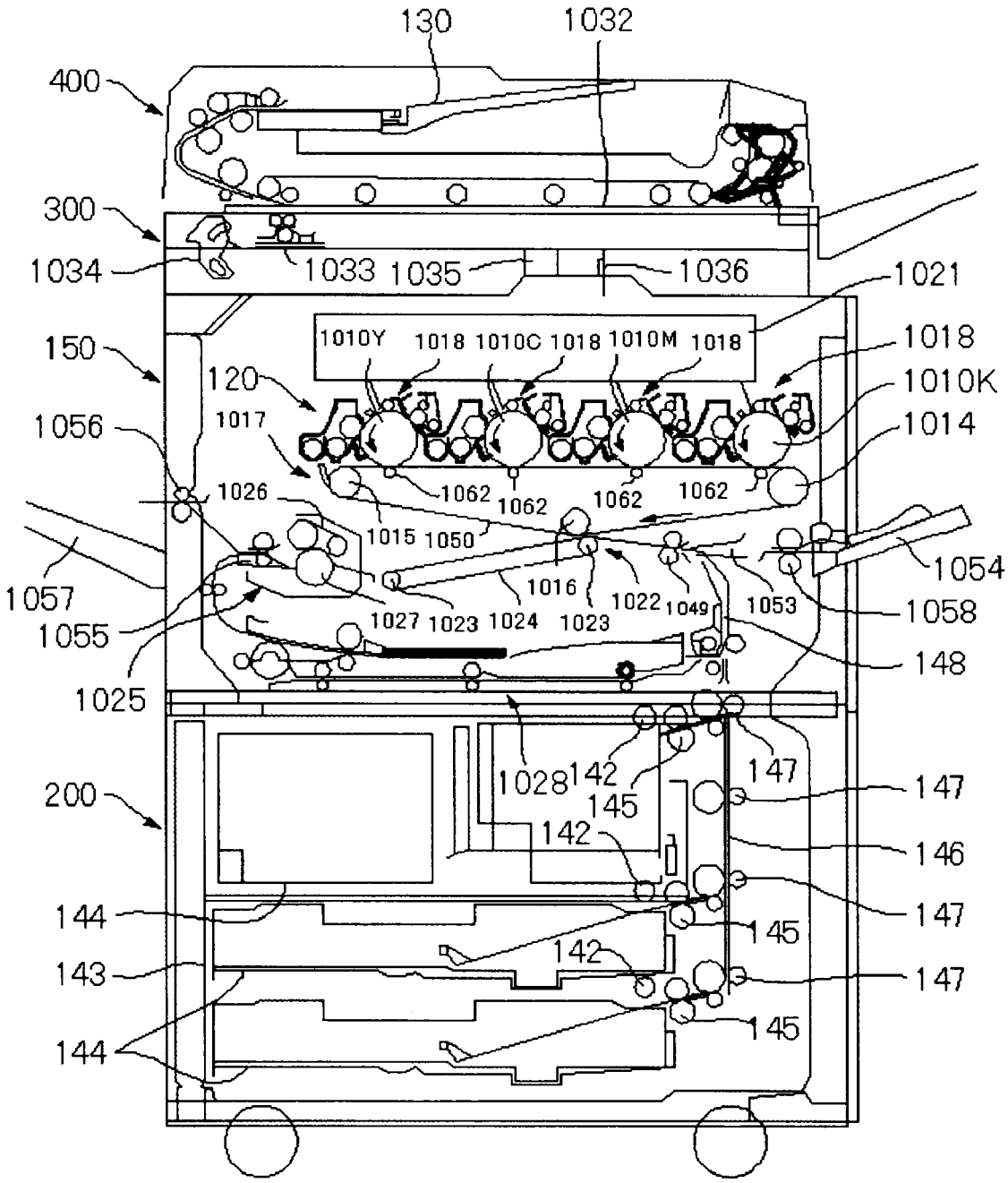
FIG. 4 is a schematic explanatory diagram showing an example of an image forming apparatus (tandem color image forming apparatus) used in an image forming method of the present invention.

Still another embodiment of the image forming method of the present invention by means of the image forming apparatus will be described with reference to FIG. 4. Image forming apparatus shown in FIG. 4 is a tandem color image-forming apparatus. The tandem image forming apparatus contains a copy machine main body 150, feeder table 200, scanner 300, and automatic document feeder (ADF) 400.

The copy machine main body 150 has an endless-belt intermediate transfer member 1050 in the center. The intermediate transfer member 1050 is looped around support rollers 1014, 1015 and 1016 and is configured to be rotatable in a clockwise direction in FIG. 4. A cleaning unit 1017 for the intermediate transfer member is provided in the vicinity of the support roller 1015. The cleaning unit 1017 removes toner particles remaining on the intermediate transfer member 1050. On the intermediate transfer member 1050 looped around the support rollers 1014 and 1015, four color-image forming units 1018—yellow, cyan, magenta, and black—are aligned along the conveying direction so as to face the intermediate transfer member 1050, which constitutes a tandem developing unit 120. An exposing unit 1021 is arranged adjacent to the tandem developing unit 120. A secondary transferring unit 1022 is arranged across the intermediate transfer member 1050 from the tandem developing unit 120. The secondary transferring unit 1022 contains a secondary transferring belt 1024, which is an endless belt and looped around a pair of rollers 1023. A transferred sheet which is conveyed on the secondary transferring belt 1024 is allowed to contact the intermediate transfer member 1050. An image fixing unit 1025 is arranged in the vicinity of the secondary transferring unit 1022. The image fixing unit 1025 contains a fixing belt 1026 which is an endless belt, and a pressurizing roller 1027 which is pressed by the fixing belt 1026.

In the tandem image forming apparatus, a sheet reverser 1028 is arranged adjacent to both the secondary transferring unit 1022 and image fixing unit 1025. A sheet reverser 1028 turns over a transferred sheet to form images on the both sides of the sheet.

Next, full-color image formation (color copying) using a tandem developing unit 120 will be described. At first, a source document is placed on a document tray 130 of an automatic document feeder 400. Alternatively, the automatic document feeder 400 is opened, the source document is placed on a contact glass 1032 of a scanner 300, and the automatic document feeder 400 is closed.

When a start switch (not shown) is pushed, the source document placed on the automatic document feeder 400 is transferred onto the contact glass 1032, and the scanner 300 is then driven to operate first and second carriages 1033 and 1034. In a case where the source document is originally placed on the contact glass 1032, the scanner 300 is immediately driven after pushing of the start switch. Light is applied from a light source to the document by means of the first carriage 1033, and light reflected from the document is further reflected by the mirror of the second carriage 1034. The reflected light passes through the image-forming lens 1035, and read the sensor 1036 receives it. In this way the color document (color image) is scanned, producing 4 types of color image information—black, yellow, magenta, and cyan.

Figure 5:
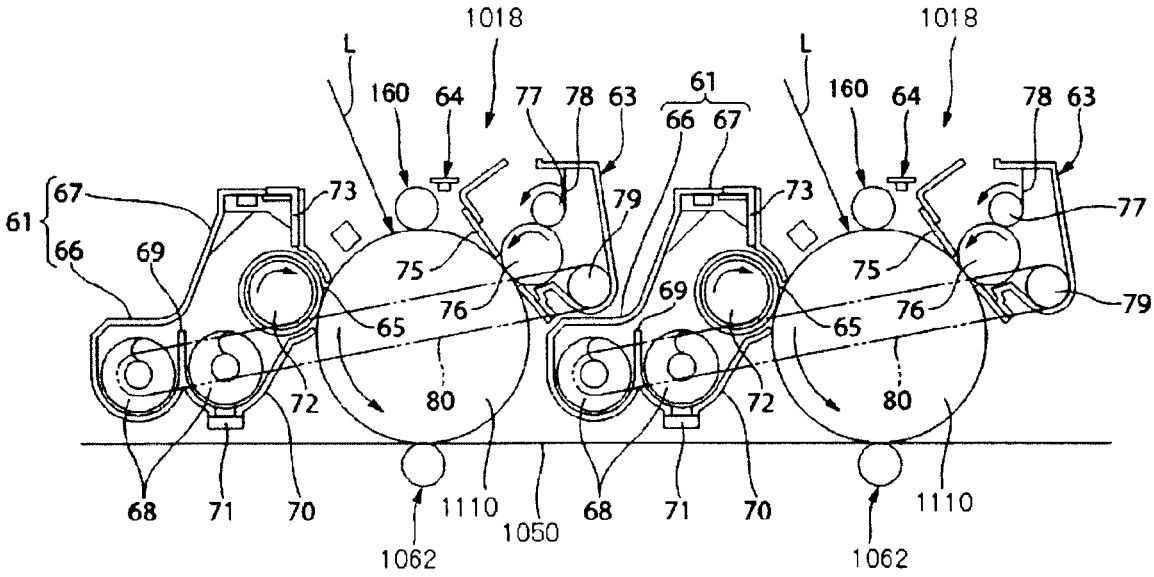
FIG. 5 is a partially enlarged schematic explanatory diagram in relation to the image forming apparatus shown in FIG. 4.

Each image information of black, yellow, magenta, and cyan is transmitted to an image forming unit 1018 (black image forming unit, yellow image forming unit, magenta image forming unit, or cyan image forming unit) of the tandem developing unit 120, and toner images of each color are formed in each image-forming unit 1018. As shown in FIG. 5, each image-forming unit 1018 (black image-forming unit, yellow image forming unit, magenta image forming unit, and cyan image forming unit) of the tandem developing unit 120 contains: a photoconductor 1110 (photoconductor for black 1010K, photoconductor for yellow 1010Y, photoconductor for magenta 1010M, or photoconductor for cyan 1010C); a charging unit 160 for uniformly charging the photoconductor 1110; an exposing unit for forming a latent electrostatic image corresponding to the color image on the photoconductor by exposing imagewisely (denoted by "L" in FIG. 5) on the basis of the corresponding color image information; a developing unit 61 for developing the latent electrostatic image using the corresponding color toner (black toner, yellow toner, magenta toner, or cyan toner) to form a toner image of each color; a transfer charger 1062 for transferring the toner image to an intermediate transfer member 1050, a cleaning unit 63, and a charge eliminating unit 64. Thus, images of one color (a black image, a yellow image, a magenta image, and a cyan image) can be formed based on the color image information. The black toner image formed on the photoconductor for black 1010K, yellow toner image formed on the photoconductor for yellow 1010Y, magenta toner image formed on the photoconductor for magenta 1010M, and cyan toner image formed on the photoconductor for cyan 1010C are sequentially transferred onto the intermediate transfer member 1050 which rotates by means of support rollers 1014, 1015 and 1016 (primary transferring). These toner images are superimposed on the intermediate transfer member 1050 to form a composite color image (color transferred image).

Meanwhile, one of feed rollers 142 of the feed table 200 is selected and rotated, whereby sheets (recording paper) are ejected from one of multiple feed cassettes 144 in a paper bank 143 and are separated one by one by a separation roller 145. Thereafter, the sheets are fed to feed path 146, transferred by a transfer roller 147 into a feed path 148 inside the copying machine main body 150, and are bumped against the resist roller 1049 to stop. Alternatively, one of the feed rollers 142 is rotated to eject sheets (recording paper) placed on a manual feed tray 1054. The sheets are then separated one by one by means of the separation roller 1058, fed into a manual feed path 1053, and similarly, bumped against the resist roller 1049 to stop. Note that the resist roller 1049 is generally earthed, but it may be biased for removing paper dusts on the sheets. The resist roller 1049 is rotated synchronously with the movement of the composite color image (color transferred image) on the intermediate transfer member 1050 to transfer the sheet (recording sheet) into between the intermediate transfer member 1050 and the secondary transferring unit 1022, and the composite color image (color transferred image) is transferred onto the sheet by means of the secondary transferring unit 1022 (secondary transferring). In this way the color image is formed on the sheet (recording sheet). Note that after image transferring, toner particles remaining on the intermediate transfer member 1050 are cleaned by means of the cleaning unit 1017.

The sheet (recording paper) bearing the transferred color image is conveyed by the secondary transferring unit 1022 into the image fixing unit 1025, where the composite color image (color transferred image) is fixed onto the sheet (recording paper) by heat and pressure. Thereafter, the sheet changes its direction by action of a switch hook 1055, ejected by an ejecting roller 1056, and stacked on an output tray 1057. Alternatively, the sheet changes its direction by action of the switch hook 1055, flipped over by means of the sheet reverser 1028, and transferred back to the image transfer section for recording of another image on the other side. The sheet that bears images on both sides is then ejected by means of the ejecting roller 1056, and is stacked on the output tray 1057.

The image forming method and image forming apparatus of the present invention can form a high quality image by using the toner of the present invention, which has a sharp particle size distribution and favorable toner properties such as chargeability, environmental adaptability and stability over time.

EXAMPLES

Hereinafter, the examples of the present invention will be explained, but the present invention shall not be construed to limit by these examples. All part(s) are expressed by mass unless indicated otherwise.

Synthesis Example 1

Synthesis of Colorant 1 Obtained by Reacting a Polymer with a Basic Dye

A 1 L four-neck flask equipped with a stirrer, condenser, thermometer, and nitrogen gas inlet tube was purged with a nitrogen gas, and 25 g of distilled water was charged therein, and then the temperature of the distilled water was increased up to 90° C. by heating the flask in an oil bath. Into the heated distilled water, an aqueous monomer solution in which 125 g of sodium p-styrene sulfonate was dissolved in 360 g of distilled water, and an aqueous polymerization initiator solution in which 2 g of ammonium persulfate was dissolved in 15 g of distilled water were separately dripped through a dropping funnel for 3 hours, and then the mixture was polymerized for 2 hours. Thereafter, the reaction solution was cooled down to room temperature to thereby obtain an aqueous polymer solution. The thus obtained aqueous polymer solution was poured into methanol so as to deposit and refine a polymer. Fifty (50) g of the thus obtained polymer and 18 g of Cathilon Yellow GLH (C.I. Basic Yellow 14, manufactured by Hodogaya Chemical Co., Ltd.) were dissolved in 500 g of water, and then 5 g of 50% aqueous acetic acid solution was further added so as to adjust the pH value to 3.5, and stirred for 1 hour at a temperature of 60° C. Thereafter, the sediment was filtered, purified, and dried to thereby obtain Colorant 1.

The Method for Elemental Analysis

The amount of a monomer having a sulfonic acid group, a sulfonic acid salt group, a sulfuric acid group or a sulfuric acid salt group in a polymer can be calculated by means of a sulfur elemental analysis. The sulfur elemental analysis can be measured using "ZSX100e" manufactured by Rigaku CORPORATION.

The obtained copolymer is washed and dried, and then weighed in approximately 2 g, and pressure-molded with 30 mm-ring by a motorized sample molder manufactured by Rigaku CORPORATION to prepare a flat sample.

The sample is measured by applying a certain electrical voltage and current and using a detector at a diffraction angle of 2θ, and then subtracting the background therefrom to obtain an intensity. Thus, the amount of sulfur can be obtained. The specific measurement is performed in accordance with the instruction manual of "ZSX100e".

Synthesis Example 2

Synthesis of Colorant 2 Obtained by Reacting a Polymer with a Basic Dye

Colorant 2 was obtained in the same manner as in Synthesis Example 1, except that Cathilon Yellow GLH was replaced with Cathilon Brilliant Red 4GH (C.I. Basic Red 14, manufactured by Hodogaya Chemical Co., Ltd.).

Synthesis Example 3

Synthesis of Colorant 3 Obtained by Reacting a Polymer with a Basic Dye

Colorant 3 was obtained in the same manner as in Synthesis Example 1, except that Cathilon Yellow GLH was replaced with Cathilon Blue 5GLH (C.I. Basic Blue 45, manufactured by Hodogaya Chemical Co., Ltd.).

Synthesis Example 4

Synthesis of Colorant 4 Obtained by Reacting a Polymer with a Basic Dye

A 1 L reaction device equipped with a stirrer, condenser, thermometer, and nitrogen gas inlet tube was purged with a nitrogen gas, and 7 g of distilled water and 13 g of ethyl alcohol were charged therein, and then the temperature of the solution was increased up to 70° C. by heating in an oil bath. Into the heated solution, an aqueous monomer solution in which 83.3 g of butyl acrylate and 21.7 g of sodium p-styrene sulfonate were dissolved in 60 g of distilled water, and a polymerization initiator solution in which 5 g of azobisisobutyronitrile was dissolved in 250 g of ethanol were separately dripped through a dropping funnel for 3 hours, and then the mixture was polymerized for 5 hours and cooled down to the room temperature. To 50 g of the thus obtained polymer solution, 210 g of water was added, and while stirring the solution, a solution in which 2.9 g of Cathilon Yellow GLH (C.I. Basic Yellow 14, manufactured by Hodogaya Chemical Co., Ltd.) and 15 g of acetic acid were dissolved in 100 g of water was dripped therein, to thereby deposit a dyed resin. The pH value of the thus obtained solution was adjusted to 4 with 20% aqueous sodium hydroxide solution, and the solution was stirred for 30 minutes at a temperature of 50° C. Thereafter, the sediment was filtered, purified, and dried to thereby obtain Colorant 4.

Synthesis Example 5

Synthesis of Colorant 5 Obtained by Reacting a Polymer with a Basic Dye

Colorant 5 was obtained in the same manner as in Synthesis Example 4, except that Cathilon Yellow GLH was replaced with Cathilon Brilliant Red 4GH (C.I. Basic Red 14, manufactured by Hodogaya Chemical Co., Ltd.).

Synthesis Example 6

Synthesis of Colorant 6 Obtained by Reacting a Polymer with a Basic Dye

Colorant 6 was obtained in the same manner as in Synthesis Example 4, except that Cathilon Yellow GLH was replaced with Cathilon Blue 5GLH (C.I. Basic Blue 45, manufactured by Hodogaya Chemical Co., Ltd.).

Synthesis Example 7

Synthesis of Colorant 7 Obtained by Reacting a Polymer with a Basic Dye

A 1 L reaction device equipped with a stirrer, condenser, thermometer, and nitrogen gas inlet tube was purged with a nitrogen gas, and 60 g of N-methyl pyrrolidone was charged therein, and then the temperature of N-methyl pyrrolidone was increased up to 90° C. by heating in an oil bath. Into the heated N-methylpyrrolidone, a monomer solution in which 25.6 g of n-butyl acrylate and 18.7 g of 2-acrylamide-2-methylpropane sulfonic acid were dissolved in 200 g of N-methylpyrrolidone, and a polymerization initiator solution in which 2 g of azobisisobutyronitrile was dissolved in 100 g of ethanol were separately dripped through a dropping funnel for 5 hours, and the mixture was polymerized for 10 hours and cooled down to room temperature. To 50 g of the thus obtained polymer solution, 3.9 g of Cathilon Yellow GLH (C.I. Basic Yellow 14, manufactured by Hodogaya Chemical Co., Ltd.) was added and stirred for 1 hour while maintaining the temperature of the mixture liquid at 70° C. The thus obtained solution was added in a large amount of distilled water so as to deposit a colored resin. Thereafter, the sediment was filtered, purified, and dried to thereby obtain Colorant 7.

Synthesis Example 8

Synthesis of Colorant 8 Obtained by Reacting a Polymer with a Basic Dye

Colorant 8 was obtained in the same manner as in Synthesis Example 7, except that Cathilon Yellow GLH was replaced with Cathilon Brilliant Red 4GH (C.I. Basic Red 14, manufactured by Hodogaya Chemical Co., Ltd.).

Synthesis Example 9

Synthesis of Colorant 9 Obtained by Reacting a Polymer with a Basic Dye

Colorant 9 was obtained in the same manner as in Synthesis Example 7, except that Cathilon Yellow GLH was replaced with Cathilon Blue 5GLH (C.I. Basic Blue 45, manufactured by Hodogaya Chemical Co., Ltd.).

Synthesis Example 10

Synthesis of Colorant 10 Obtained by Reacting a Polymer with a Basic Dye

A 1 L reaction device equipped with a stirrer, condenser, thermometer, and nitrogen gas inlet tube was purged with a nitrogen gas, and 100 g of ethanol, 35.4 g of styrene, 7.7 g of butyl acrylate, 0.8 g of ethyleneglycol dimethacrylate, and 6.2 g of 2-acrylamide-2-methylpropane sulfonic acid were charged therein, and then the temperature of the mixture liquid was increased up to 70° C. by heating in an oil bath. Into the heated solution, a polymerization initiator solution in which 1 g of azobisisobutylonitrile was dissolved in 100 g of ethanol was dripped through a dropping funnel for 5 hours, and the mixture was polymerized for 5 hours and cooled down to room temperature. To the thus obtained polymer solution, 3 g of 10% aqueous sodium hydroxide solution was added and sufficiently stirred, and then a colored liquid in which 1.2 g of Cathilon Yellow GLH (C.I. Basic Yellow 14, manufactured by Hodogaya Chemical Co., Ltd.) was dissolved in 100 g of water was charged, and acetic acid was further added so as to adjust the pH value to 5. Thereafter, the solution was stirred for 1 hour while maintaining the temperature at 60° C. The thus obtained solution was added in a large amount of distilled water so as to deposit a colored resin. The sediment was then filtered, purified, and dried to thereby obtain Colorant 10.

Synthesis Example 11

Synthesis of Colorant 11 Obtained by Reacting a Polymer with a Basic Dye

Colorant 11 was obtained in the same manner as in Synthesis Example 10, except that Cathilon Yellow GLH was replaced with Cathilon Brilliant Red 4GH (C.I. Basic Red 14, manufactured by Hodogaya Chemical Co., Ltd.).

Synthesis Example 12

Synthesis of Colorant 12 Obtained by Reacting a Polymer with a Basic Dye

Colorant 12 was obtained in the same manner as in Synthesis Example 10, except that Cathilon Yellow GLH was replaced with Cathilon Blue 5GLH (C.I. Basic Blue 45, manufactured by Hodogaya Chemical Co., Ltd.).

Synthesis Example 13

Synthesis of Colorant 13 Obtained by Reacting a Polymer with a Basic Dye

A 1 L four-neck flask equipped with a stirrer, condenser, thermometer, and nitrogen gas inlet tube was purged with a nitrogen gas, 25 g of distilled water was charged therein, and then the temperature of the distilled water was increased up to 90° C. by heating the flask in an oil bath. Into the heated distilled water, an aqueous monomer solution in which 14.4 g of sodium p-styrene sulfonate and 91.1 g of 2-hydroxyethyl methacrylate were dissolved in 300 g of distilled water, and an aqueous polymerization initiator solution in which 7.5 g of ammonium persulfate was dissolved in 75 g of distilled water were separately dripped through a dropping funnel for 3 hours, and the mixture was polymerized for 2 hours and cooled down to room temperature. Hundred (100) g of the thus obtained aqueous polymer solution, 1 g of Cathilon Yellow GLH (C.I. Basic Yellow 14, manufactured by Hodogaya Chemical Co., Ltd.), 1 g of 50% aqueous acetic acid solution and 20 g of distilled water were mixed so as to adjust the pH value to 3.5, and stirred for 1 hour at a temperature of 60° C. Thereafter, the thus obtained solution was spray-dried by means of MINISPRAY GS310 (manufactured by Yamato Scientific Co., Ltd.) to thereby obtain Colorant 13.

Synthesis Example 14

Synthesis of Colorant 14 Obtained by Reacting a Polymer with a Basic Dye

Colorant 14 was obtained in the same manner as in Synthesis Example 13, except that Cathilon Yellow GLH was replaced with Cathilon Brilliant Red 4GH (C.I. Basic Red 14, manufactured by Hodogaya Chemical Co., Ltd.).

Synthesis Example 15

Synthesis of Colorant 15 Obtained by Reacting a Polymer with a Basic Dye

Colorant 15 was obtained in the same manner as in Synthesis Example 13, except that Cathilon Yellow GLH was replaced with Cathilon Blue 5GLH (C.I. Basic Blue 45, manufactured by Hodogaya Chemical Co., Ltd.).

Synthesis Example 16

Synthesis of Colorant 16 Obtained by Reacting a Polymer with a Basic Dye

A 1 L four-neck flask equipped with a stirrer, condenser, thermometer, and nitrogen gas inlet tube was purged with a nitrogen gas, 25 g of distilled water was charged therein, and then the temperature of the distilled water was increased up to 90° C. by heating the flask in an oil bath. Into the heated distilled water, an aqueous monomer solution in which 45.4 g of sodium p-styrene sulfonate and 88.5 g of 2-hydroxyethyl methacrylate were dissolved in 300 g of distilled water, and an aqueous polymerization initiator solution in which 1.25 g of ammonium persulfate was dissolved in 50 g of distilled water were separately dripped through dropping funnels for three hours, and the mixture was polymerized for 2 hours, and cooled down to room temperature. Hundred (100) g of the thus obtained aqueous polymer solution, 1 g of Cathilon Yellow GLH (C.I. Basic Yellow 14, manufactured by Hodogaya Chemical Co., Ltd.), 1 g of 50% aqueous acetic acid solution and 20 g of distilled water were mixed so as to adjust the pH value to 3.5, and stirred for 1 hour at a temperature of 60° C. Thereafter, the thus obtained solution was spray-dried by means of MINISPRAY GS310 (manufactured by Yamato Scientific Co., Ltd.) to thereby obtain Colorant 16.

Synthesis Example 17

Synthesis of Colorant 17 Obtained by Reacting a Polymer with a Basic Dye

Colorant 17 was obtained in the same manner as in Synthesis Example 16, except that Cathilon Yellow GLH was replaced with Cathilon Brilliant Red 4GH (C.I. Basic Red 14, manufactured by Hodogaya Chemical Co., Ltd.).

Synthesis Example 18

Synthesis of Colorant 18 Obtained by Reacting a Polymer with a Basic Dye

Colorant 18 was obtained in the same manner as in Synthesis Example 16, except that Cathilon Yellow GLH was replaced with Cathilon Blue 5GLH (C.I. Basic Blue 45, manufactured by Hodogaya Chemical Co., Ltd.).

Synthesis Example 19

Synthesis of Polyester 1 as a Binder Resin

Into a reaction vessel equipped with a thermometer, stirrer, condenser, and nitrogen gas inlet tube, 64 parts of PO adduct of bisphenol A (hydroxyl value: 320), 544 parts of EO adduct of bisphenol A (hydroxyl value: 343), 123 parts of terephthalic acid, and 4 parts of dibutylthioxaide were charged, and the mixture was reacted under normal pressure for 3 hours at a temperature of 230° C. The reaction solution was then cooled down to 180° C., and 296 parts of dodecenylsuccinic anhydride was further added therein. The solution was then reacted under a reduced pressure of 10 mmHg to 15 mmHg until the acid value thereof became 2 mgKOH/g or less. Thereafter, in the solution, 20 parts of trimellitic anhydride was added, and the mixture liquid was reacted under normal pressure for 2 hours at a temperature of 180° C. The reactant was taken out from the reaction vessel to thereby yield Polyester 1. Polyester 1 had a glass transition temperature (Tg) of 48° C., a number average molecular mass of 9,000, a mass average molecular mass of 22,000, an acid value of 10 mgKOH/g, and a hydroxyl value of 17 mgKOH/g.

Synthesis Example 20

Synthesis of Polyester 2 as a Binder Resin

Into a reaction vessel equipped with a thermometer, stirrer, condenser and nitrogen gas inlet tube, 636 parts of PO adduct of bisphenol A (hydroxyl value: 320), 191 parts of terephthalic acid, and 4 parts of dibutylthioxaide were charged, and the mixture was reacted under normal pressure for 3 hours at a temperature of 230° C. The reaction solution was then cooled down to 180° C., 205 parts of dodecenylsuccinic anhydride was further added therein. The solution was then reacted under a reduced pressure of 10 mmHg to 15 mmHg until the acid value thereof became 2 mgKOH/g or less. Thereafter, in the solution 20 parts of trimellitic anhydride was added, and the mixture liquid was reacted under normal pressure for 2 hours at a temperature of 180° C. The reactant was taken out from the reaction vessel to thereby yield Polyester 2. Polyester 2 had a glass transition temperature (Tg) of 55° C., a number average molecular mass of 5,000, a mass average molecular mass of 10,000, an acid value of 11 mgKOH/g, and a hydroxyl value of 16 mgKOH/g.

Synthesis Example 21

Synthesis of Polyester 3 as a Binder Resin

In a reaction vessel equipped with a cooling tube, a stirrer, and a nitrogen gas inlet tube, 229 parts of ethylene oxide 2-mol adduct of bisphenol A, 529 parts of a propylene oxide 3-mol adduct of bisphenol A, 208 parts of terephthalic acid, 46 parts of adipic acid, and 2 parts of dibutyltin oxide were charged and reacted under normal pressure for 8 hours at a temperature of 230° C. Then, the mixture was further reacted under a reduced pressure of 10 mmHg to 15 mmHg for 5 hours. Thereafter, in the reaction vessel 44 parts of trimellitic anhydride was added, and the mixture liquid was reacted under the normal pressure for 2 hours at a temperature of 180° C. to thereby yield Polyester 3. Polyester 3 had a number average molecular mass of 2,500, a mass average molecular mass of 6,700, a glass transition temperature (Tg) of 43° C. and an acid value of 25 mgKOH/g.

Synthesis Example 22

Synthesis of Prepolymer 1

Next, in a reaction vessel equipped with a cooling tube, a stirrer, and a nitrogen gas inlet tube, 682 parts of ethylene oxide 2-mol adduct of bisphenol A, 81 parts of a propylene oxide 2-mol adduct of bisphenol A, 283 parts of terephthalic acid, 22 parts of trimellitic anhydride and 2 parts of dibutyltin oxide were charged, and reacted under normal pressure for 8 hours at a temperature of 230° C. Then, the mixture was further reacted under a reduced pressure of 10 mmHg to 15 mmHg for 5 hours. The obtained polyester had a number average molecular mass of 2,100, a mass average molecular mass of 9,500, a glass transition temperature (Tg) of 55° C., an acid value of 0.5 mgKOH/g, and a hydroxyl value of 51 mgKOH/g. Thereafter, in a reaction vessel equipped with a cooling tube, a stirrer, and a nitrogen gas inlet tube, 410 parts of the obtained polyester, 89 parts of isophorone diisocyanate, and 500 parts of ethyl acetate were charged and reacted for 5 hours at a temperature of 100° C. to yield Prepolymer 1. The obtained Prepolymer 1 had a free isocyanate content of 1.53% by mass.

Synthesis Example 23

Synthesis of Ketimine Compound 1

Into a reaction vessel equipped with a stirring rod and a thermometer, 170 parts of isophoronediamine and 75 parts of methyl ethyl ketone were loaded, followed by reaction at 50° C. for 5 hours to thereby synthesize Ketimine Compound 1. The thus obtained Ketimine Compound 1 had an amine value of 418 mg KOH/g.

Example 1

In a vessel, 3 parts of magnesium phosphate was added to 900 parts of ion-exchanged water which was heated at a temperature of 60° C., and stirred using T.K. HOMO MIXER (manufactured by Tokushu Kika Kogyo Co., Ltd.) at 10,000 rpm to prepare an aqueous medium.

Next, 85 parts of styrene monomer, 15 parts of n-butyl acrylate, 10 parts of the Colorant 1, 2 parts of styrene-methacrylic acid-methyl methacrylate (85:5:10) having a molecular mass of 58,000, 15 parts of carnauba wax, 4 parts of zinc di-t-butyl salicylate were mixed and heated at a temperature of 60° C., and uniformly dispersed and dissolved using T.K. HOMO MIXER (manufactured by Tokushu Kika Kogyo Co., Ltd.) at 12,000 rpm. In the mixture, as a polymerization initiator 2.5 parts of 1,1'-azobis(cyclohexane-1-carbonitrile) was dissolved to prepare a polymerizable monomer composition.

In the aqueous medium, the thus obtained polymerizable monomer composition was loaded and then stirred using the T.K. HOMO MIXER at 8,000 rpm under a nitrogen atmosphere at a temperature of 60° C. for granulation.

Thereafter, the mixture was moved in a stirring machine having a paddle type stirring blade, and continuously stirred and the temperature of the mixture was increased up to 70° C. for 2 hours, and then 4 hour later, further heated up to 80° C. at a temperature rise rate of 40° C./Hr, and the mixture was subjected to reaction at a temperature of 80° C. for 5 hours. Thereafter, a styrene monomer was removed by distillation, to complete the reaction. After polymerization reaction was completed, a slurry containing the particles was cooled and washed with water in an amount of 10 times as much as the slurry, and filtrated, dried and classified to adjust particle size, to thereby yield particles. Next, 0.2 parts of hydrophobic silica (AEROSIL R-972, manufactured by NIPPON AEROSIL CO., LTD.) was added in 100 parts of the obtained particles, and mixed by a HENSCHEL MIXER to prepare Yellow Toner 1. In the same manner, Magenta Toner 1 and Cyan Toner 1 were respectively prepared using Colorants 2 and 3.

Example 2

Yellow Toner 2, Magenta Toner 2, and Cyan Toner 2 were respectively prepared in the same manner as in Example 1, except that Colorants 1 to 3 used each in an amount of 1 part were respectively replaced with Colorants 4 to 6 used each in an amount of 3 parts.

Example 3

Yellow Toner 3, Magenta Toner 3, and Cyan Toner 3 were respectively prepared in the same manner as in Example 1, except that Colorants 1 to 3 used each in an amount of 1 part were respectively replaced with Colorants 7 to 9 used each in an amount of 2 parts.

Example 4

Yellow Toner 4, Magenta Toner 4, and Cyan Toner 4 were respectively prepared in the same manner as in Example 1, except that Colorants 1 to 3 used each in an amount of 1 part were respectively replaced with Colorants 10 to 12 used each in an amount of 4.5 parts.

Example 5

Yellow Toner 5, Magenta Toner 5, and Cyan Toner 5 were respectively prepared in the same manner as in Example 1, except that Colorants 1 to 3 used each in an amount of 1 part were respectively replaced with Colorants 13 to 15 used each in an amount of 4 parts.

Example 6

Yellow Toner 6, Magenta Toner 6, and Cyan Toner 6 were respectively prepared in the same manner as in Example 1, except that Colorants 1 to 3 used each in an amount of 1 part were respectively replaced with Colorants 16 to 18 used each in an amount of 3 parts.

Example 7

In a mixer equipped with a stirring blade, 18 parts of carnauba wax, 2 parts of a wax dispersant, and 80 parts of ethyl acetate were charged and subjected to a primary dispersion so as to form a primary dispersion liquid. The primary dispersion liquid was heated to 80° C. while being stirred so as to dissolve the carnauba wax therein, and then the primary dispersion was cooled to room temperature so as to deposit wax particles having a maximum particle diameter of 3 μm or less. As the wax dispersant, polyethylene wax to which styrene-butyl acrylate copolymer had been grafted was used. The thus obtained dispersion liquid was further dispersed finely under a strong shear force by means of Dyno-mill so as to control the maximum particle diameter of the wax particles to be 2 μm or less, whereby a dispersion liquid of the carnauba wax was obtained.

In a mixer equipped with a stirring blade, 100 parts of Polyester 2 as a binder resin, 1 part of Colorant 1, 25 parts of the dispersion liquid of the carnauba wax, 0.4 parts of FTERGENT F100 (manufactured by Neos Company Limited) were charged to 120 parts of ethyl acetate, and stirred for 10 minutes so as to disperse the components, to thereby obtain a toner composition liquid. On the other hand, 60 parts of calcium carbonate having an average particle diameter of 80 nm, and 40 parts of water were dispersed by a ball mill for 24 hours, and 7 parts of the obtained dispersion liquid of calcium carbonate and 100 parts of 2% aqueous carboxymethylcellulose solution (CELLOGEN BS-H manufactured by Dai-ichi Kogyo Seiyaku Co., Ltd.) were stirred by a T.K. HOMO MIXER manufactured by Tokushukika Kogyo Co., Ltd.), and then 50 parts of the toner composition liquid was slowly charged therein to suspend the mixture liquid. Thereafter, the solvent was removed under a reduced pressure, and then 100 parts of 6N hydrochloric acid was added to remove calcium carbonate, and then the mixture liquid was washed, dried and classified. Next, 0.2 parts of hydrophobic silica (AEROSIL R-972, manufactured by NIPPON AEROSIL CO., LTD.) was added in 100 parts of the obtained particles, and mixed by a HENSCHEL MIXER to prepare Yellow Toner 7. In the same manner, Magenta Toner 7 and Cyan Toner 7 were respectively prepared using Colorants 2 and 3.

Example 8

Yellow Toner 8, Magenta Toner 8, and Cyan Toner 8 were respectively prepared in the same manner as in Example 7, except that Colorants 1 to 3 used each in an amount of 1 part were respectively replaced with Colorants 4 to 6 used each in an amount of 3 parts.

Example 9

Yellow Toner 9, Magenta Toner 9, and Cyan Toner 9 were respectively prepared in the same manner as in Example 7, except that Colorants 1 to 3 used each in an amount of 1 part were respectively replaced with Colorants 7 to 9 used each in an amount of 2 parts.

Example 10

Yellow Toner 10, Magenta Toner 10, and Cyan Toner 10 were respectively prepared in the same manner as in Example 7, except that Colorants 1 to 3 used each in an amount of 1 part were respectively replaced with Colorants 10 to 12 used each in an amount of 4.5 parts.

Example 11

Yellow Toner 11, Magenta Toner 11, and Cyan Toner 11 were respectively prepared in the same manner as in Example 7, except that Colorants 1 to 3 used each in an amount of 1 part were respectively replaced with Colorants 13 to 15 used each in an amount of 4 parts.

Example 12

Yellow Toner 12, Magenta Toner 12, and Cyan Toner 12 were respectively prepared in the same manner as in Example 7, except that Colorants 1 to 3 used each in an amount of 1 part were respectively replaced with Colorants 16 to 18 used each in an amount of 3 parts.

Example 13

Yellow Toner 13, Magenta Toner 13, and Cyan Toner 13 were respectively prepared in the same manner as in Example 7, except that Colorants 1 to 3 used each in an amount of 1 part were respectively replaced with Colorants 13 to 15 used each in an amount of 100 parts.

Example 14

In a vessel equipped with a stirrer and a thermometer, 683 parts of distilled water, 11 parts of sodium salt of sulfate ester of methacrylic acid ethylene oxide adduct (ELEMINOL RS-30, manufactured by Sanyo Chemical Industries, Ltd.), 83 parts of styrene, 83 parts of methacrylic acid, 110 parts of butyl acrylate, and 1 part of ammonium persulfate were charged and stirred at 400 rpm for 15 minutes. Then, the temperature of the solution was increased up to 75° C., and the solution was subjected to reaction for 5 hours. In the vessel, 30 parts of 1% ammonium persulfate was further added and matured at 75° C. for 5 hours to obtain a dispersion liquid of a copolymer of styrene-methacrylic acid-butyl acrylate-sodium salt of sulfuric acid ester of ethylene oxide adduct of methacrylic acid. The volume average particle diameter of the dispersion liquid of fine resin particle, which was measured by a laser particle size distribution analyzer LA-920, was 105 nm. A part of the dispersion liquid of fine resin particle was dried to isolate a resin component, and then a glass transition temperature (Tg) and molecular mass of the resin component were measured. The resin component had a glass transition temperature (Tg) of 59° C. and a mass average molecular mass of 150,000.

Then 83 parts of the dispersion liquid of obtained fine resin particles, 990 parts of distilled water, 37 parts of a 48.5% aqueous solution of sodium dodecyl diphenyl ether disulfonate (ELEMINOL MON-7 manufactured by Sanyo Chemical Industries, Ltd.), and 90 parts of ethyl acetate were mixed and stirred to obtain an aqueous phase.

In a vessel equipped with a stirrer and a thermometer, 95 parts of Polyester 3, 28 parts of carnauba wax and 225 parts of ethyl acetate were charged, and the temperature of the solution was increased up to 80° C. while stirring, and the solution was maintained at a temperature of 80° C. for 5 hours, and then cooled to 30° C. for 1 hour. Then, 1 part of Colorant 1 and 125 parts of ethyl acetate were charged and mixed for 1 hour to obtain starting solution.

Eighty (80) parts of the starting solution was dispersed by a bead mill (ULTRAVISCOMILL manufactured by Aimex Co., Ltd.) which was filled with 80% by volume of 0.5 mm-zirconia beads under the conditions of a liquid feeding speed of 1 kg/hr, a disk circumferential speed of 6 m/sec., and 3 times-pass through. Next, 80 parts of a 65% ethyl acetate solution of Polyester 3 was further added, and then passed through the bead mill 1 time under the above conditions, thereby obtaining Colorant/Wax dispersion liquid having a solid content concentration of 50% (130° C., 30 min.).

In a vessel 185 parts of Colorant pigment/Wax dispersion liquid, 26 parts of Prepolymer 1, and 0.7 parts of Ketimine Compound 1 were charged and mixed by T.K. HOMO MIXER (manufactured by Tokushukika Kogyo Co., Ltd.) at 5,000 rpm for 1 minute, to thereby yield a toner composition liquid. In the obtained toner composition liquid, 300 parts of the aqueous phase was added, and mixed by T.K. HOMO MIXER (manufactured by Tokushukika Kogyo Co., Ltd.) at 13,000 rpm for 20 minutes, to thereby yield an emulsified slurry. In a vessel equipped with a stirrer and thermometer, the emulsified slurry was charged, and de-solvated at a temperature of 30° C. for 8 hours, and continuously stirred at a temperature of 45° C. for 4 hours. This was filtrated under a reduced pressure, ion-exchanged water was added to the filter cake, mixed using T.K. HOMO MIXER at 12,000 rpm for 10 minutes, and then filtered again. Into the obtained filter cake, 10% hydrochloric acid was added to adjust the pH to 2.8, and mixed by T.K. HOMO MIXER at 12,000 rpm for 10 minutes, and then filtered. To the filter cake 300 parts of ion-exchanged water was added, and mixed by means of T.K. HOMO MIXER at 12,000 rpm for 10 minutes and then filtered. This operation was repeated twice to yield a filter cake. The obtained filter cake was dried at 45° C. for 48 hours in a circulating air dryer, and then it was passed through a sieve of 75 μm mesh to yield particles. Next, 0.2 parts of hydrophobic silica (AEROSIL R-972, manufactured by NIPPON AEROSIL CO., LTD.) was added in 100 parts of the obtained particles, and mixed by a HENSCHEL MIXER to prepare Yellow Toner 14. In the same manner, Magenta Toner 14 and Cyan Toner 14 were respectively prepared using Colorants 2 and 3.

Example 15

Yellow Toner 15, Magenta Toner 15, and Cyan Toner 15 were respectively prepared in the same manner as in Example 14, except that Colorants 1 to 3 used each in an amount of 1 part were respectively replaced with Colorants 4 to 6 used each in an amount of 3 parts.

Example 16

Yellow Toner 16, Magenta Toner 16, and Cyan Toner 16 were respectively prepared in the same manner as in Example 14, except that Colorants 1 to 3 used each in an amount of 1 part were respectively replaced with Colorants 7 to 9 used each in an amount of 2 parts.

Example 17

Yellow Toner 17, Magenta Toner 17, and Cyan Toner 17 were respectively prepared in the same manner as in Example 14, except that Colorants 1 to 3 used each in an amount of 1 part were respectively replaced with Colorants 10 to 12 used each in an amount of 4.5 parts.

Example 18

Yellow Toner 18, Magenta Toner 18, and Cyan Toner 18 were respectively prepared in the same manner as in Example 14, except that Colorants 1 to 3 used each in an amount of 1 part were respectively replaced with Colorants 13 to 15 used each in an amount of 4 parts.

Example 19

Yellow Toner 19, Magenta Toner 19, and Cyan Toner 19 were respectively prepared in the same manner as in Example 14, except that Colorants 1 to 3 used each in an amount of 1 part were respectively replaced with Colorants 16 to 18 used each in an amount of 3 parts.

Comparative Example 1

Preparation of Colorant Dispersion Liquid

Fifteen (15) parts of a yellow pigment (Novoperm Yellow P-HG manufactured by Clariant Japan K.K.) and 3 parts of a pigment dispersant were dispersed in 82 parts of ethyl acetate by means of a mixer equipped with a stirring blade so as to prepare a primary dispersion liquid. As the pigment dispersant, AJISPER PB821 manufactured by Ajinomoto Fine-Techno Co., Inc. was used. The thus obtained primary dispersion liquid was further finely dispersed under strong shear force by means of Dyno-mill so as to obtain the dispersion liquid from which aggregates were completely removed. Moreover, the thus obtained dispersion liquid was passed through a PTFE filter having fine pores of 0.45 μm to thereby obtain Pigment Dispersion Liquid 1 in which the pigment was dispersed to submicron order particles.

Fifteen (15) parts of a magenta pigment (HOSTERPERM PINK E-02 manufactured by Clariant Japan K.K.) and 3 parts of a pigment dispersant were dispersed in 82 parts of ethyl acetate by means of a mixer equipped with a stirring blade so as to prepare a primary dispersion liquid. As the pigment dispersant, AJISPER PB821 manufactured by Ajinomoto Fine-Techno Co., Inc. was used. The thus obtained primary dispersion liquid was further finely dispersed under strong shear force by means of Dyno-mill so as to obtain the dispersion liquid from which aggregates were completely removed. Moreover, the thus obtained dispersion liquid was passed through a PTFE filter having fine pores of 0.45 μm to thereby obtain Pigment Dispersion Liquid 2 in which the pigment was dispersed to submicron order particles.

Fifteen (15) parts of a cyan pigment (LIONOL BLUE FG-7351 manufactured by Toyo Ink Mfg. Co., Ltd.) and 3 parts of a pigment dispersant were dispersed in 82 parts of ethyl acetate by means of a mixer equipped with a stirring blade so as to prepare a primary dispersion liquid. As the pigment dispersant, AJISPER PB821 manufactured by Ajinomoto Fine-Techno Co., Inc. was used. The thus obtained primary dispersion liquid was further finely dispersed under strong shear force by means of Dyno-mill so as to obtain the dispersion liquid from which aggregates were completely removed. Moreover, the thus obtained dispersion liquid was passed through a PTFE filter having fine pores of 0.45 μm to thereby obtain Pigment Dispersion Liquid 3 in which the pigment was dispersed to submicron order particles.

Yellow Toner 20, Magenta Toner 20, and Cyan Toner 20 were respectively prepared in the same manner as in Example 1, except that Colorants 1 to 3 used each in an amount of 1 part were respectively replaced with Pigment Dispersants 1 to 3 used each in an amount of 40 parts.

Comparative Example 2

Yellow Toner 21, Magenta Toner 21, and Cyan Toner 21 were respectively prepared in the same manner as in Example 1, except that 1 part of each Colorant 1 to 3 was replaced with 3 parts of basic dyes, i.e. 3 parts of a yellow dye (Mikketon Polyester Yellow YL, manufactured by Mitsui Chemicals, Inc.), 3 parts of a magenta dye (Sumikaron Brilliant Red S-BLF, manufactured by Sumitomo Chemical Co., Ltd.), and 3 part of a cyan dye (Sumikaron Turquoise Blue S-GL, manufactured by Sumitomo Chemical Co., Ltd.).

Comparative Example 3

Yellow Toner 22, magenta Toner 22, and Cyan Toner 22 were respectively prepared in the same manner as in Example 7, except that Colorants 1 to 3 used each in an amount of 1 part were respectively replaced with Pigment Dispersants 1 to 3 used each in an amount of 40 parts.

Comparative Example 4

Yellow Toner 23, Magenta Toner 23, and Cyan Toner 23 were respectively prepared in the same manner as in Example 7, except that 1 part of each Colorant 1 to 3 was respectively replaced with 3 parts of basic dyes, i.e. 3 parts of a yellow dye (Mikketon Polyester Yellow YL, manufactured by Mitsui Chemicals, Inc.), 3 parts of a magenta dye (Sumikaron Brilliant Red S-BLF, manufactured by Sumitomo Chemical Co., Ltd.), and 3 parts of a cyan dye (Sumikaron Turquoise Blue S-GL, manufactured by Sumitomo Chemical Co., Ltd.).

Comparative Example 5

Yellow Toner 24, Magenta Toner 24, and Cyan Toner 24 were respectively prepared in the same manner as in Example 14, except that Colorants 1 to 3 used each in an amount of 1 part were respectively replaced with Pigment Dispersants 1 to 3 used each in an amount of 40 parts.

Comparative Example 6

Yellow Toner 25, Magenta Toner 25, and Cyan Toner 25 were respectively prepared in the same manner as in Example 14, except that 1 part of each Colorant 1 to 3 was respectively replaced with 3 parts of basic dyes, i.e. 3 parts of a yellow dye (Mikketon Polyester Yellow YL, manufactured by Mitsui Chemicals, Inc.), 3 parts of a magenta dye (Sumikaron Brilliant Red S-BLF, manufactured by Sumitomo Chemical Co., Ltd.), and 3 parts of a cyan dye (Sumikaron Turquoise Blue S-GL, manufactured by Sumitomo Chemical Co., Ltd.).

<Measurement of Mass Average Particle Diameter and Particle Size Distribution>

The mass average particle diameter and particle size distribution of each toner were measured using COULTER COUNTER TA-II manufactured by Beckman Coulter, Inc. in accordance with a Coulter Counter method. The mass average particle diameter (D4) and number average particle diameter (Dn) of a toner were found based on the obtained particle size distribution.

Moreover, a ratio (D4/Dn) was found based on the thus obtained mass average particle diameter (D4) and number average particle diameter (Dn) of the toner. The results are shown in Tables 1-1 to 1-3.

—Preparation of a Developer—

A silicone resin (SR2441 manufactured by Dow Corning Toray Co., Ltd.) was diluted to thereby obtain a silicone resin solution having a solid content of 5%. With respect to the solid content, 3% of an aminosilane coupling agent, i.e. $H_2N(CH_2)_3Si(OC_2H_5)_3$, was added to the silicone resin solution. The thus obtained silicone resin solution was applied to Cu—Zn ferrite particles (F-300, manufactured by Powdertech Co., Ltd.) so as to coat the surface of each particles at approximately 40 g/min in an atmosphere at a temperature of 100° C. by means of a fluid bed coating device, and the coated particles were further heated at a temperature of 240° C. for 2 hours to thereby yield a carrier coated with a silicone resin layer having 0.38 μm-thick.

Next, respective developers consisting of 5 parts of respective toner and 95 parts of the silicone coated Cu—Zn ferrite carrier were prepared.

Next, the image density and image quality of each developer were measured in the following manner.

<Image Density and Image Quality>

Using each of the thus obtained developer, a chart with an image area of 5% and a toner deposition amount of 0.50±0.05 mg/cm$^2$ was formed on a copy paper (TYPE 6000, manufactured by Ricoh Company, Ltd.) by means of a tandem color printer (IPSIO SPC811, manufactured by Ricoh Company, Ltd.). In this manner, the image was continuously formed on 100,000 sheets of the copy paper in an environment at a temperature of 20° C. and 60% RH, and then the measurement of image density and evaluation of image quality was performed. Thereafter, in the same manner, the image was continuously formed on 5,000 sheets in respective environments at 10° C. and 30% RH, and 30° C. and 90% RH, and then the measurement of image density and evaluation of image quality were performed.

The image density was measured by means of a spectrodensitometer X-RITE 938 (manufactured by X-Rite Inc.) under the conditions that $D_{65}$ light source, a view angle of 2 degrees, and status T were used, and evaluated based on the following criteria.

[Evaluation Criteria]

A: 1.4 or more

B: 1.2 or more and less than 1.4

C: less than 1.2

As the evaluation of the coloring performance, chroma (C*) was measured by means of the same device under the same conditions as mentioned above, and evaluated based on the following criteria.

A: C* was 75 or more

B: C* was 60 or more to less than 75

C: C* was less than 60

As the evaluation of the transparency, an image was formed on an OHP sheet (TYPE ST, manufactured by Ricoh Company, Ltd.) so as to have a toner deposition amount of 0.50±0.05 mg/cm$^2$ using each toner, and the thus obtained image was subjected to a measurement by means of a direct-reading digital haze computer HGM-2DP manufactured by Suga Test Instruments Co., Ltd.

[Evaluation Criteria]

A: Less than 10%

B: 10% or more to less than 20%

C: 20% or more

Moreover, the image was comprehensively evaluated by visually observing background smear, image bleeding, image blur and thin-spot.

[Evaluation Criteria]

A: No background smear, image bleeding, image blur and thin-spot were observed.

B: Any of background smear, image bleeding, image blur and thin-spot were slightly observed.

C: Any of background smear, image bleeding, image blur and thin-spot were observed.

<Light Fastness>

As a sample, a solid image (50 mm×30 mm) was formed on copy paper (TYPE 6000, manufactured by Ricoh Company, Ltd.) using each toner with a toner deposition amount of 0.50±0.05 mg/cm$^2$, and this image sample was subjected to a light fastness test for 15 hours by means of a light fastness tester XW-150 (manufactured by Shimadzu Corporation). In this test, a*, b*, L* were measured on the initial image, and the image after being exposed for 15 hours, and ΔE was calculated based on the following equation. The light fastness was evaluated based on the thus obtained ΔE using the evaluation criteria below.

$$\Delta E = \sqrt{\begin{array}{l}(a^*_{Intial} - a^*_{After\ 15\,hours})^2 + \\ (b^*_{Intial} - b^*_{After\ 15\,hours})^2 + \\ (L^*_{Intial} - L^*_{After\ 15\,hours})^2\end{array}}$$

[Evaluation Criteria]

A: Less than 5

B: 5 or more and less than 8

C: 8 or more

Note that, with regard to Toners 7, 14, 21 and 30, each image was formed so as to have a toner deposition amount of 0.10±0.05 g/cm$^2$, and then evaluated.

The evaluation results of coloring performance and light fastness at the initial stage, and the evaluation results of image density and image quality at the initial stage, after the image formed on 10,000 sheets in an environment at 20° C. and 60% RH, after the image formed on another 5,000 (15,000 in total) in an environment at 10° C. and 30% RH, and after the image formed on another 5,000 (20,000 in total) in an environment at 30° C. and 90% RH, are shown in Tables 1-1 to 1-3.

TABLE 1-1

| | | Mass average particle diameter (μm) | Particle size distribution D4/Dn | Initial stage | | | | | 20° C. 60% RH after image formation on 10,000 sheets | | 10° C. 30% RH after image formation on 5,000 sheets | | 30° C. 90% RH after image formation on 5,000 sheets | |
|---|---|---|---|---|---|---|---|---|---|---|---|---|---|---|
| | | | | Image density | Image evaluation | Coloring performance | Transparency | Light fastness | Image density | Image evaluation | Image density | Image evaluation | Image density | Image evaluation |
| Toner 1 | Y | 6.9 | 1.23 | A | A | A | A | A | A | A | A | A | A | A |
| | M | 6.6 | 1.29 | A | A | A | A | B | A | A | A | A | A | A |
| | C | 7.0 | 1.25 | A | A | A | A | A | A | A | A | A | A | A |
| Toner 2 | Y | 6.9 | 1.23 | A | A | A | A | A | A | A | A | A | A | A |
| | M | 6.6 | 1.27 | A | A | A | A | B | A | A | A | A | A | A |
| | C | 6.8 | 1.25 | A | A | A | A | A | A | A | A | A | A | A |
| Toner 3 | Y | 7.6 | 1.32 | A | A | A | A | A | A | A | A | A | A | A |
| | M | 7.4 | 1.30 | A | A | A | A | B | A | A | A | A | A | A |
| | C | 7.1 | 1.27 | A | A | A | A | A | A | A | A | A | A | A |
| Toner 4 | Y | 7.0 | 1.25 | A | A | A | A | A | A | A | A | A | A | A |
| | M | 6.7 | 1.26 | A | A | A | A | B | A | A | A | A | A | A |
| | C | 6.6 | 1.24 | A | A | A | A | A | A | A | A | A | A | A |
| Toner 5 | Y | 6.6 | 1.22 | A | A | A | A | A | A | A | A | A | A | A |
| | M | 6.9 | 1.26 | A | A | A | A | B | A | A | A | A | A | A |
| | C | 7.4 | 1.30 | A | A | A | A | A | A | A | A | A | A | A |
| Toner 6 | Y | 7.1 | 1.27 | A | A | A | A | A | A | A | A | A | A | A |
| | M | 7.0 | 1.25 | A | A | A | A | B | A | A | A | A | A | A |
| | C | 6.7 | 1.31 | A | A | A | A | A | A | A | A | A | A | A |
| Toner 7 | Y | 6.4 | 1.26 | A | A | A | A | A | A | A | A | A | A | A |
| | M | 6.3 | 1.25 | A | A | A | A | B | A | A | A | A | A | A |
| | C | 6.5 | 1.28 | A | A | A | A | A | A | A | A | A | A | A |
| Toner 8 | Y | 6.8 | 1.28 | A | A | A | A | A | A | A | A | A | A | A |
| | M | 7.0 | 1.33 | A | A | A | A | B | A | A | A | A | A | A |
| | C | 6.8 | 1.32 | A | A | A | A | A | A | A | A | A | A | A |

TABLE 1-2

| | | Mass average particle diameter (μm) | Particle size distribution D4/Dn | Initial stage | | | | | 20° C. 60% RH after image formation on 10,000 sheets | | 10° C. 30% RH after image formation on 5,000 sheets | | 30° C. 90% RH after image formation on 5,000 sheets | |
|---|---|---|---|---|---|---|---|---|---|---|---|---|---|---|
| | | | | Image density | Image evaluation | Coloring performance | Transparency | Light fastness | Image density | Image evaluation | Image density | Image evaluation | Image density | Image evaluation |
| Toner 9 | Y | 6.6 | 1.28 | A | A | A | A | A | A | A | A | A | A | A |
| | M | 6.4 | 1.26 | A | A | A | A | B | A | A | A | A | A | A |
| | C | 6.1 | 1.23 | A | A | A | A | A | A | A | A | A | A | A |
| Toner 10 | Y | 6.0 | 1.21 | A | A | A | A | A | A | A | A | A | A | A |
| | M | 6.8 | 1.29 | A | A | A | A | B | A | A | A | A | A | A |
| | C | 7.0 | 1.33 | A | A | A | A | A | A | A | A | A | A | A |
| Toner 11 | Y | 6.7 | 1.30 | A | A | A | A | A | A | A | A | A | A | A |
| | M | 6.6 | 1.28 | A | A | A | A | B | A | A | A | A | A | A |
| | C | 6.4 | 1.26 | A | A | A | A | A | A | A | A | A | A | A |
| Toner 12 | Y | 6.1 | 1.23 | A | A | A | A | A | A | A | A | A | A | A |
| | M | 6.0 | 1.21 | A | A | A | A | B | A | A | A | A | A | A |
| | C | 7.1 | 1.31 | A | A | A | A | A | A | A | A | A | A | A |
| Toner 13 | Y | 7.0 | 1.28 | A | A | A | A | A | A | A | A | A | A | A |
| | M | 6.7 | 1.30 | A | A | A | A | B | A | A | A | A | A | A |
| | C | 6.6 | 1.28 | A | A | A | A | A | A | A | A | A | A | A |

TABLE 1-2-continued

| | | Mass average particle diameter (μm) | Particle size distribution D4/Dn | Initial stage | | | | | 20° C. 60% RH after image formation on 10,000 sheets | | 10° C. 30% RH after image formation on 5,000 sheets | | 30° C. 90% RH after image formation on 5,000 sheets | |
|---|---|---|---|---|---|---|---|---|---|---|---|---|---|---|
| | | | | Image density | Image evaluation | Coloring performance | Transparency | Light fastness | Image density | Image evaluation | Image density | Image evaluation | Image density | Image evaluation |
| Toner 14 | Y | 5.3 | 1.13 | A | A | A | A | A | A | A | A | A | A | A |
| | M | 5.3 | 1.12 | A | A | A | A | B | A | A | A | A | A | A |
| | C | 5.4 | 1.11 | A | A | A | A | A | A | A | A | A | A | A |
| Toner 15 | Y | 5.3 | 1.16 | A | A | A | A | A | A | A | A | A | A | A |
| | M | 5.1 | 1.09 | A | A | A | A | B | A | A | A | A | A | A |
| | C | 5.2 | 1.11 | A | A | A | A | A | A | A | A | A | A | A |
| Toner 16 | Y | 5.2 | 1.12 | A | A | A | A | A | A | A | A | A | A | A |
| | M | 5.3 | 1.13 | A | A | A | A | B | A | A | A | A | A | A |
| | C | 5.3 | 1.09 | A | A | A | A | A | A | A | A | A | A | A |
| Toner 17 | Y | 5.4 | 1.14 | A | A | A | A | A | A | A | A | A | A | A |
| | M | 5.2 | 1.13 | A | A | A | A | B | A | A | A | A | A | A |
| | C | 5.1 | 1.09 | A | A | A | A | A | A | A | A | A | A | A |

TABLE 1-3

| | | Mass average particle diameter (μm) | Particle size distribution D4/Dn | Initial stage | | | | | 20° C. 60% RH after image formation on 10,000 sheets | | 10° C. 30% RH after image formation on 5,000 sheets | | 30° C. 90% RH after image formation on 5,000 sheets | |
|---|---|---|---|---|---|---|---|---|---|---|---|---|---|---|
| | | | | Image density | Image evaluation | Coloring performance | Transparency | Light fastness | Image density | Image evaluation | Image density | Image evaluation | Image density | Image evaluation |
| Toner 18 | Y | 5.2 | 1.11 | A | A | A | A | A | A | A | A | A | A | A |
| | M | 5.2 | 1.09 | A | A | A | A | B | A | A | A | A | A | A |
| | C | 5.3 | 1.12 | A | A | A | A | A | A | A | A | A | A | A |
| Toner 19 | Y | 5.3 | 1.14 | A | A | A | A | A | A | A | A | A | A | A |
| | M | 5.4 | 1.14 | A | A | A | A | B | A | A | A | A | A | A |
| | C | 5.2 | 1.12 | A | A | A | A | A | A | A | A | A | A | A |
| Toner 20 | Y | 7.3 | 1.39 | A | A | C | C | A | A | A | B | A | A | C |
| | M | 7.2 | 1.41 | A | A | C | C | A | A | A | A | B | A | C |
| | C | 7.9 | 1.38 | A | A | B | B | A | A | A | A | A | A | B |
| Toner 21 | Y | 6.5 | 1.28 | A | A | A | A | C | A | A | B | A | A | A |
| | M | 6.8 | 1.28 | A | A | A | A | C | A | A | A | A | A | A |
| | C | 7.0 | 1.33 | A | A | A | A | C | A | A | A | A | A | A |
| Toner 22 | Y | 6.9 | 1.36 | A | A | B | B | A | A | A | B | A | A | C |
| | M | 6.8 | 1.39 | A | A | B | B | A | A | A | A | B | A | C |
| | C | 7.3 | 1.37 | A | A | B | B | A | A | A | A | A | A | C |
| Toner 23 | Y | 7.0 | 1.31 | A | A | A | A | C | A | A | B | A | A | A |
| | M | 6.8 | 1.32 | A | A | A | A | C | A | A | A | A | A | A |
| | C | 6.6 | 1.28 | A | A | A | A | C | A | A | A | A | A | A |
| Toner 24 | Y | 5.1 | 1.16 | A | A | B | B | A | A | A | B | A | A | B |
| | M | 5.3 | 1.18 | A | A | B | B | A | A | A | A | A | A | B |
| | C | 5.6 | 1.17 | A | A | B | B | A | A | A | A | A | A | B |
| Toner 25 | Y | 5.3 | 1.12 | A | A | A | A | C | A | A | B | A | A | A |
| | M | 5.3 | 1.14 | A | A | A | A | C | A | A | A | A | A | A |
| | C | 5.4 | 1.14 | A | A | A | A | C | A | A | A | A | A | A |

As can be seen from the results of Tables 1-1 to 1-3, the developer obtained by using the colorant according to the present invention has a narrow particle size distribution, and can obtain an image having high transparency and high chroma, and stable high image quality, compared to a developer containing the toner of the Comparative Example, which is obtained by dispersing the pigment, in the same production method as that of the present invention. Use of the colorant in the present invention enables to obtain a toner, which does not practically cause a problem of discoloration due to light, by contrast, use of a dye colorant, which is as effective as the colorant used in the present invention in the transparency and chroma, causes the problem.

By using the colorant for the toner of the present invention, particles having a sharp particle size distribution can be produced, and high image quality can be stably obtained. Therefore, the toner using the colorant of the present invention is preferably used in a developer for developing an electrostatic charge image in electrophotography, electrostatic recording, electrostatic printing, and the like.

Moreover, as the toner of the present invention can form a color image having high transparency and high chroma, it can be preferably used in a developer for developing an electrostatic charge image in electrophotography, electrostatic recording, electrostatic printing, and the like.

What is claimed is:

1. A toner for developing an electrostatic charge image, the toner comprising:

a colorant obtained by reacting a polymer with a basic dye, wherein the polymer comprises 10 mol % or more of a monomer unit having any one of a sulfonic acid group, a sulfonic acid salt group, a sulfuric acid group and a sulfuric acid salt group as a constitutional unit, and wherein the toner is obtained by forming a toner composition liquid containing at least the colorant into oil droplets in an aqueous medium, and solidifying the oil droplets into solid particles.

2. The toner according to claim 1, wherein the toner composition liquid is prepared by dissolving at least the colorant in an organic solvent.

3. The toner according to claim 1, wherein the polymer comprises 10 mol % or more of at least one monomer unit selected from the group consisting of 2-(meth)acrylamido-2-methylpropanesulfonic acid, salts of 2-(meth)acrylamido-2-methylpropanesulfonic acid, styrenesulfonic acid and salts of styrenesulfonic acid as a constitutional unit.

4. The toner according to claim 1, wherein the polymer comprises 10 mol % or more of at least one monomer unit selected from the group consisting of 2-(meth)acrylamido-2-methylpropanesulfonic acid, salts of 2-(meth)acrylamido-2-methylpropanesulfonic acid, styrenesulfonic acid and salts of styrenesulfonic acid as a constitutional unit, and also comprises a monomer unit of an acrylate or methacrylate alkyl ester as a constitutional unit.

5. The toner according to claim 1, wherein the process of forming the toner composition liquid into oil droplets in the aqueous medium and solidifying the oil droplets into solid particles is based upon a suspension polymerization method.

6. The toner according to claim 1, wherein the process of forming the toner composition liquid into oil droplets in the aqueous medium and solidifying the oil droplets into solid particles is based upon a dissolution suspension method.

7. The toner according to claim 1, wherein the process of forming the toner composition liquid into oil droplets in the aqueous medium and solidifying the oil droplets into solid particles is a process in which a toner composition liquid prepared by dissolving or dispersing in an organic solvent the colorant and a polymer that serves as a binder resin having a site reactable with a compound having at least an active hydrogen group is dispersed and formed into oil droplets in an aqueous medium, the oil droplets are solidified into solid particles by removing the organic solvent after or while subjecting the binder resin having a site reactable with a compound having an active hydrogen group to a reaction with the compound having an active hydrogen group, then the solid particles are washed and dried.

8. An image forming method comprising:

forming a latent electrostatic image on a latent electrostatic image bearing member, developing the latent electrostatic image, using a toner for developing an electrostatic charge image, so as to form a visible image, transferring the visible image onto a recording medium, and fixing the transferred visible image on the recording medium by heating and pressurizing the visible image with the use of a fixing member in the form of one of a roller and a belt, wherein the toner comprises at least a colorant obtained by reacting a polymer with a basic dye, wherein the polymer comprises 10 mol % or more of a monomer unit having any one of a sulfonic acid group, a sulfonic acid salt group, a sulfuric acid group and a sulfuric acid salt group as a constitutional unit, and wherein the toner is obtained by forming a toner composition liquid containing at least the colorant into oil droplets in an aqueous medium, and solidifying the oil droplets into solid particles.

9. An image forming apparatus comprising:

a latent electrostatic image bearing member, a latent electrostatic image forming unit configured to form a latent electrostatic image on the latent electrostatic image bearing member, a developing unit configured to develop the latent electrostatic image, using a toner for developing an electrostatic charge image, so as to form a visible image, a transfer unit configured to transfer the visible image onto a recording medium, and a fixing unit configured to fix the transferred visible image on the recording medium by heating and pressurizing the visible image with the use of a fixing member in the form of one of a roller and a belt, wherein the toner comprises at least a colorant obtained by reacting a polymer with a basic dye, wherein the polymer comprises 10 mol % or more of a monomer unit having any one of a sulfonic acid group, a sulfonic acid salt group, a sulfuric acid group and a sulfuric acid salt group as a constitutional unit, and wherein the toner is obtained by forming a toner composition liquid containing at least the colorant into oil droplets in an aqueous medium, and solidifying the oil droplets into solid particles.

* * * * *